US006997456B2

(12) United States Patent
Fukatsu et al.

(10) Patent No.: US 6,997,456 B2
(45) Date of Patent: Feb. 14, 2006

(54) SHEET PROCESSING DEVICE WITH SHEET LIFT PREVENTING MEMBER AND IMAGE FORMING APPARATUS HAVING THE SAME

(75) Inventors: Masayoshi Fukatsu, Shizuoka (JP); Takashi Kuwata, Shizuoka (JP); Jun-ichi Sekiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 10/621,345

(22) Filed: Jul. 18, 2003

(65) Prior Publication Data

US 2004/0022567 A1 Feb. 5, 2004

(30) Foreign Application Priority Data

Jul. 31, 2002 (JP) ..... 2002-224144

(51) Int. Cl.
*B65H 29/54* (2006.01)

(52) U.S. Cl. ..... 271/306; 271/189; 271/207; 271/220; 270/58.08; 270/58.12

(58) Field of Classification Search ..... 271/314, 271/207, 306, 189, 220; 270/58.08, 58.11, 270/58.12

See application file for complete search history.

(56) References Cited

U.S. PATENT DOCUMENTS

| | | | | |
|---|---|---|---|---|
| 5,765,826 | A | 6/1998 | Isoda et al. | 271/162 |
| 6,302,606 | B1 | 10/2001 | Hayakawa et al. | 400/625 |
| 6,318,718 | B1 | 11/2001 | Ogata et al. | 271/213 |
| 6,325,371 | B1 | 12/2001 | Araki et al. | 271/297 |
| 6,382,616 | B1 | 5/2002 | Waragai et al. | 270/58.12 |
| 6,942,206 | B1 * | 9/2005 | Kuwata et al. | 270/58.08 |
| 2002/0081124 | A1 | 6/2002 | Kuwata et al. | 399/107 |
| 2003/0044209 | A1 | 3/2003 | Isobe et al. | 399/410 |

* cited by examiner

*Primary Examiner*—David H. Bollinger
(74) *Attorney, Agent, or Firm*—Fitzpatrick, Cella, Harper & Scinto

(57) ABSTRACT

A sheet processing device of the invention has an upper conveying guide, being rotatable in the vertical direction, for guiding the upper surface of the sheet, a lower conveying guide, on which the sheets are stacked, for guiding the lower surface of the sheet, upper and lower sheet-discharging rollers, for discharging the sheet, on the downstream side of the upper conveying guide, an arm for shifting the upper sheet-discharging roller in the vertical direction, a cam for pushing the arm upward, a stapler for stapling the sheets stacked on the lower conveying guide, a link portion and a link lever for shifting the upper conveying guide upward when the arm is shifted upward by the cam, a reference wall for receiving the sheets, stacked on the lower conveying guide, and a sheet lift preventing member, which moves away from the sheet when the downstream end of the upper conveying guide is located at the lower position and which holds the sheet when the downstream end of the upper conveying guide is shifted upward.

31 Claims, 24 Drawing Sheets

SHEET PROCESSING DEVICE WITH SHEET LIFT PREVENTING MEMBER AND IMAGE FORMING APPARATUS HAVING THE SAME

BACKGROUND OF THE INVENTION

1. Field of the Invention

The present invention relates to a sheet processing device for carrying out processing on sheets, and to an image forming apparatus having the sheet processing device in a main body of the apparatus and forming an image on sheets and then allowing the sheet processing device to carry out processing on the sheet. More specifically, the invention relates to a sheet processing device in which the vertical space of a sheet path is reduced and the sheet is prevented from lifting up, and to an image forming apparatus having the same.

2. Description of the Related Art

Conventionally, for example, sheet processing devices align the ends of sheets received from a main body of an image forming apparatus at an intermediate stacking station, carry out processing at a sheet processing unit where the sheets are stapled together, and discharge and stack the sheets. The intermediate stacking station includes the sheet processing unit, which corresponds to sheet processing means, intermediate rollers, and sheet-discharging rollers. The sheet processing unit is disposed upstream of the nip of the intermediate roller in the sheet conveying direction.

Therefore, in the sheet processing mode, the conventional sheet processing device reverses the sheet conveying direction to an upstream direction once the sheet has passed between the intermediate rollers until the sheet is brought into abutment with a reference wall, so that the rear ends of the sheets are aligned. Subsequently, the sheet processing device carries out processing on the sheets at the aligned position using the sheet processing unit, and discharges and finally stacks the sheets on a stacking tray using the sheet-discharging rollers.

However, in the conventional sheet processing device, since the sheet processing unit is disposed upstream of the intermediate rollers, the sheets which have passed through the intermediate rollers must be fed back in the upstream direction, and thus the device is provided with a first sheet path from the entrance of the sheet processing device to the intermediate roller, and a second sheet path from the reference wall to the discharging rollers, which are arranged on two levels, that is, one above the other. Therefore, the height of the main body of the sheet processing device is obliged to increase, and thus the size also increases.

Since a plurality of sheets are stacked when carrying out processing on the sheets, sometimes a next sheet cannot proceed onto the preceding sheet without a jam. Therefore, a holding mechanism for preventing the stacked previous sheets from lifting up is provided, and this holding mechanism also prevents the height of the main body from being reduced.

SUMMARY OF THE INVENTION

It is an object of the present invention to provide a sheet processing device for reducing the vertical space of the sheet path and preventing sheets from lifting up.

It is another object of the invention to provide an image forming apparatus including a sheet processing device for reducing the vertical space of the sheet path and preventing sheets from lifting up in a main body thereof.

In accordance with these and other objects, there is provided, a sheet processing device that includes a pair of sheet-conveying rotating members for conveying a sheet, an upper conveying guide provided on the downstream side of the pair of sheet-conveying rotating members in the sheet conveying direction for guiding the upper surface of the sheet conveyed by the pair of sheet-conveying rotating members, the upper conveying guide being shiftable in the vertical direction, a lower conveying guide provided below the upper conveying guide and opposed thereto for guiding the lower surface of the sheet conveyed by the sheet-conveying rotating members and receiving and stacking the sheets, upper guide shifting means for shifting the upper conveying guide, and a sheet lift preventing member being shiftable in the vertical direction in conjunction with the shifting movement of the upper conveying guide, and the sheet lift preventing member is shifted to the upper position in spaced relationship to the sheet when the downstream end of the upper conveying guide is shifted downward, and is shifted to the lower position for preventing the sheet from lifting when the downstream end of the upper conveying guide is shifted upward.

In one aspect of the invention, the upper conveying guide of the sheet processing device of the invention is rotatably disposed, the sheet lift preventing member is a rotatable member disposed so as to be capable of rotating, and the center of rotation of the sheet lift preventing member is set to a position upstream of the center of rotation of the upper conveying guide in the sheet conveying direction.

In another aspect of the invention, the sheet lift preventing member in the sheet processing device according to the invention is rotatably mounted on the upper conveying guide.

According to still another aspect of the sheet processing device of the invention, the sheet lift preventing member is situated in such a manner that when the upper end of the sheet lift preventing member is shifted to the upper position, the upper end abuts against a fixed member, and the lower end of the sheet lift preventing member rotates in the direction away from the sheet when the downstream end of the upper conveying guide is shifted downward.

According to still yet another aspect of the sheet processing device of the invention, the sheet lift preventing member is mounted to a fixed member so as to be capable of rotating in the vertical direction.

According to another aspect of the sheet processing device of the invention, the fixed member is a supporting shaft of the upper rotating member of the pair of sheet-conveying rotating members.

According to the sheet processing device of the invention, the sheet lift preventing member may be situated in such a manner that the lower end of the sheet lift preventing member is positioned below the nip of the pair of sheet-conveying rotating members when being in the lower position.

According to the sheet processing device of the invention, the sheet lift preventing member may be situated in such a manner that the lower end of the sheet lift preventing member is positioned above the nip of the pair of sheet-conveying rotating members when being in the upper position.

According to another aspect of the invention, urging means for rotationally urging the sheet lift preventing member in the direction to move the lower end of the sheet lift preventing member toward the sheet is further provided.

According to another aspect of the invention, the sheet lift preventing member is received by the supporting shaft of the upper rotating member of the pair of sheet-conveying rotating members.

The sheet processing member according to the invention may also include an arm member, the arm member comprising the upper sheet discharging rotating member and being shiftable in the vertical direction, and arm elevating means for shifting the arm member in the vertical direction, and the upper guide shifting means shifts the upper conveying guide in conjunction with the shifting movement of the arm member.

According to another aspect of the sheet processing device of the invention, the upper conveying guide and the arm member are disposed so as to be capable of rotating in the vertical direction about an identical center of rotation.

According to this aspect of the invention, the arm elevating means may include a cam for shifting the arm member in the vertical direction by rotating while remaining in constant contact with the arm member.

The sheet processing device of the invention may further comprise an upper sheet-discharging rotating member and a lower sheet-discharging rotating member disposed so as to oppose each other, and the upper sheet-discharging rotating member is disposed on the arm member.

According to still yet another aspect of the sheet processing device of the invention, a plurality of upper sheet-discharging rotating members and lower sheet-discharging rotating members are disposed alternately in the direction of the axis of rotation.

The sheet processing device according to the invention may further include sheet receiving means for receiving the upstream end of the sheets in the sheet conveying direction, which are stacked on the lower conveying guide, and sheet processing means, disposed downstream of the pair of sheet-conveying rotating members, for processing the sheets stacked on the lower conveying guide and received by the sheet receiving means.

According to the sheet processing device of the invention, the sheet processing means may be a stapler having a gap opening in the vertical direction, and a nip of the pair of sheet conveying rotating members and the sheet receiving means are disposed in the vertical opening region of the gap.

According to still yet another aspect of the sheet processing device of the invention, a lower portion of the stapler positioned below the opening is disposed at substantially the same level as the lower conveying guide, and an upper portion of the stapler positioned above the opening is disposed so as to be capable of moving toward and away from the lower portion.

According to still yet another aspect of the sheet processing device of the invention, the pair of sheet-conveying rotating members, the lower conveying guide, the sheet receiving means, the sheet processing means, the upper sheet-discharging rotating member and the lower sheet-discharging rotating member are substantially linearly aligned.

The sheet processing device of the invention further may include a sheet returning means for returning the sheet conveyed and stacked by the pair of sheet conveying rotating member on the lower conveying guide in the direction opposite to the sheet conveying direction and bringing the sheet into abutment with the sheet receiving means.

In still yet another aspect of the invention, the sheet processing device of the invention may be operable in one of a first processing mode and a second processing mode, the first processing mode including the steps of positioning the arm member at a lower position, and passing the sheets through the lower conveying guide and discharging the sheets with the upper sheet-discharging rotating member and the lower sheet-discharging rotating member, and the second processing mode including the steps of shifting the arm member and the upper sheet-discharging rotating member upward, stacking a predetermined number of conveyed sheets intermediately on the lower conveying guide at a position immediately after passing through the pair of sheet-conveying rotating members, performing processing on the predetermined number of sheets with the sheet processing means and shifting the arm member downward, and discharging the predetermined number of sheets by the upper sheet-discharging rotating member and the lower sheet-discharging rotating member.

In another aspect of the invention, there is provided an image forming apparatus which includes image forming means for forming an image on a sheet, and the sheet processing means for performing processing on the sheet on which the image is formed by the image forming means, and the sheet processing means is one of the aforementioned sheet processing devices.

According to another aspect of the sheet processing device of the invention, the sheet processing means is disposed downstream of the sheet-conveying means in the sheet conveying direction, and the sheet-discharging means is disposed downstream thereof, so that the sheet path from the sheet-conveying means to the sheet-discharging means extends in a substantially linearly shape and the vertical space of the sheet path is narrowed. Consequently, since holding means is arranged in the narrow space, the height of the sheet processing device itself can be reduced, and simultaneously, the following sheet is reliably placed on top of the preceding sheets when performing sheet processing. Therefore, jamming of the sheet can be prevented and thus processing of the sheet can reliably be performed.

According to still another aspect of the sheet processing device of the invention, the sheet processing means is disposed downstream side of the pair of sheet-conveying rotating members in the sheet conveying direction, the upper sheet-discharging rotating member and the lower sheet-discharging rotating member are disposed on the downstream side thereof, so that the sheet path from the pair of sheet-conveying rotating members to the upper sheet-discharging rotating member and the lower sheet-discharging rotating member extends substantially linearly, and the sheet lift preventing member, which moves away from the sheet when the downstream end of the upper conveying guide is located at the lower position, and holds the sheet when the downstream end of the upper conveying guide is shifted upward is provided. Therefore, the height of the sheet processing device itself can be reduced, and simultaneously, the following sheet is reliably placed on top of the preceding sheets when performing sheet processing, whereby the sheet is prevented from jamming so that sheet processing can reliably be performed.

According to still yet another aspect of the sheet processing device of the invention, the nip of the pair of sheet-conveying rotating members and the receiving means are accommodated in the vertical region of the gap when the gap of the sheet processing device is opened. Therefore, with the provision of the sheet lift preventing member, which can prevent the sheets from lifting in association with the shifting movement of the upper conveying guide, a straight path can be defined by the simplest construction, and the size of the entire device, particularly the height thereof can be reduced.

According to still yet another aspect of the sheet processing device of the invention, the sheet lift preventing member moves away from the sheet when the downstream end of the upper conveying guide is located at the lower position, and holds the sheet when the downstream end of the upper conveying guide is shifted upward. Therefore, noise, damages or undesired folding of the sheet, which may occur when the sheet abut against the sheet lift preventing member, or abrasion of the sheet lift preventing member can be prevented with the simplest construction at lower costs.

Further objects, features and advantages of the present invention will become apparent from the following description of the preferred embodiments (with reference to the attached drawings).

BRIEF DESCRIPTION OF THE DRAWINGS

FIG. 23 is a front view of a principal portion of a sheet processing device according to the second embodiment, in which

FIG. 24 is a front view of a principal portion of a sheet processing device according to the third embodiment, in which

DESCRIPTION OF THE PREFERRED EMBODIMENTS

Figure 1:
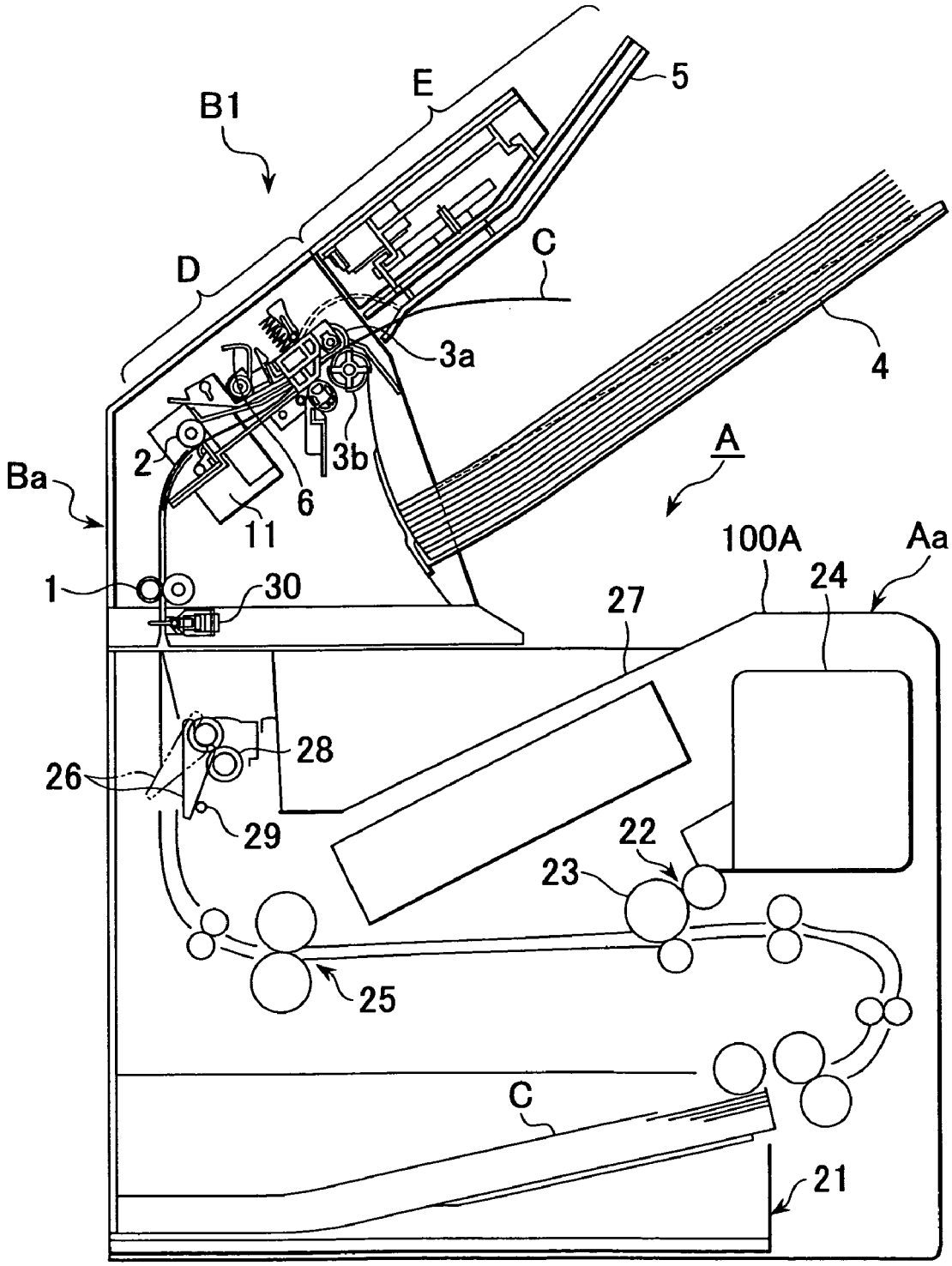
FIG. 1 is a general cross-sectional view showing a printer having a sheet processing device according to the first embodiment of the invention.

Referring now to the drawings, a sheet processing device according to an embodiment of the invention and a laser beam printer (hereinafter, referred to as a "printer"), which is an image forming apparatus having the sheet processing device, will be described. In FIG. 1 to FIG. 4, a sheet lift preventing member is not shown.

The image forming apparatus may be a printer, a copying machine, a facsimile, or a composite machine, which is a combination thereof. The sheet processing device according to the embodiment of the invention may be mounted on any one of the above-described various types of image forming apparatus, and its application is not limited to a printer.

(Printer)

FIG. 1 is a cross-sectional view showing the general construction of the image forming apparatus, for example, a printer A, provided with a sheet processing device B1 according to the first embodiment of the invention.

The sheet processing device B1 is provided on top of a main body Aa as one of the components of the printer A.

The printer A is an apparatus to be connected independently to a computer via the main body Aa, or to a network such as a LAN, for forming (printing) an image on a sheet by a predetermined image forming process based on image information or printing signals fed from the computer or the network, and discharging the sheet. The printer A may be provided with a reading unit for scanning an original, so that the image of the original on the sheet is copied based on information read by the reading unit, and then discharged.

The sheet processing device B1 discharges the sheet fed from the main body Aa as is, or discharges the sheets after widthwise aligning of the sheets into a bundle and stapling them with a stapler 11. The discharged sheets or the bundle of sheets are stacked face down on a stacking tray 4.

The sheet processing device B1 and the main body Aa are electrically connected by a cable connector (not shown). A casing unit Ba, which will be described later, for accommodating various components of the sheet processing device B1 is detachably mounted to the main body Aa.

The construction and operation of the components of the main body Aa will be described sequentially along the conveying path of the sheet C.

A plurality of sheets C are stacked in a feeding cassette 21 in the main body Aa. The plurality of sheets C are fed one by one separately from the top by various rollers. A toner image is formed on the upper surface of the sheet C fed from the feeding cassette 21 by image forming unit 22, which may be a laser beam image forming process based on predetermined printing signals fed from the computer or from the network to the main body Aa. When the sheet C is fed to the image forming unit 22, the toner image is already formed on a photoreceptor drum 23 of the image forming unit 22 by toner in a cartridge 24.

Heat and pressure are then applied to the sheet C by a fixing unit 25 on the downstream side, so that the toner image is fixed thereto. The sheet C having the fixed image thereon is selectively discharged to a face down (FD) discharging unit 27 provided on top of the main body Aa or discharged onto the stacking tray 4 of the sheet processing device B1, depending on the position of a flapper 26 of the main body Aa, which is switched in response to by control signals from the control unit (not shown).

When the flapper 26 is switched to the position shown by the broken line in FIG. 1, the sheet C is guided by the flapper 26, diverted at a substantially U-shaped sheet conveying path extending to a pair of discharging rollers 28, so that the surface having the image is turned face down, and the sheet C is discharged from the main body Aa to the face down discharging unit 27 by the pair of discharging rollers 28 with the surface having the image face down.

The printer A is constructed in such a manner that, when performing stapling processing with the stapler 11 based on commands supplied from the computer or the like in advance, the flapper 26 rotates, using a solenoid (not shown), counterclockwise from the position indicated by the broken line, abuts against a stopper 29, and stops at the position indicated by a solid line before the sheets C to be stapled are fed to the sheet processing device B1, so that the sheets C are conveyed to the sheet processing device B1.

Accordingly, the sheets C conveyed to an entrance of the sheet processing device B1 are guided by the flapper 26. The sheets C conveyed to the sheet processing device B1 are detected by an entrance sensor 30. Subsequently, the sheets C are conveyed upward by a pair of entrance rollers 1.

(Sheet Processing Device of the First Embodiment)

Figure 2:
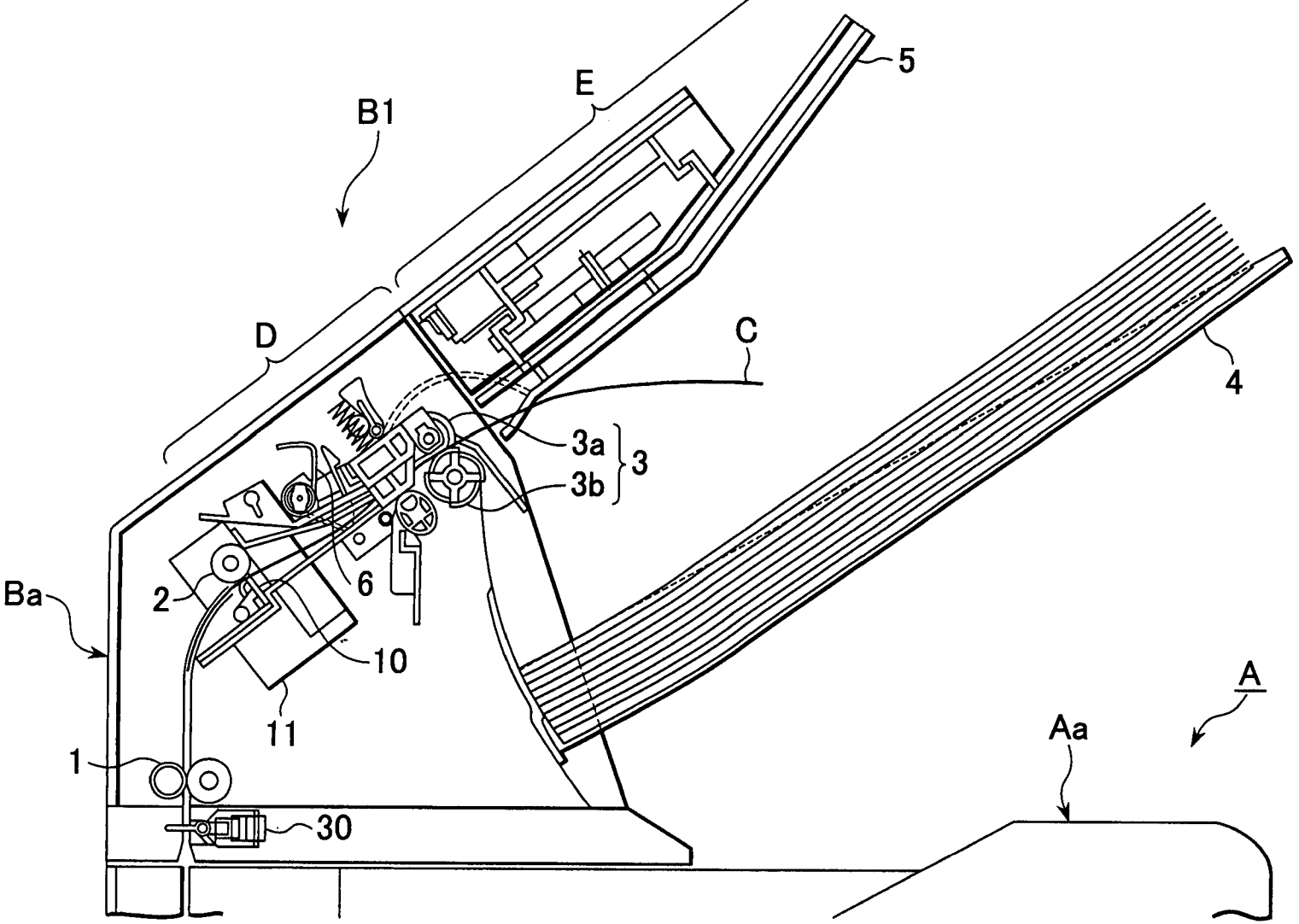
FIG. 2 is a general cross-sectional view showing a general construction of the sheet processing device according to the first embodiment of the invention.

FIG. 2 is a cross section showing a general construction of the sheet processing device B1.

The pair of entrance rollers 1 receives the sheet fed from the main body Aa, and carries it to an intermediate roller 2, which corresponds to sheet-conveying means. The intermediate roller 2 feeds the received sheet to a pair of sheet-discharging rollers 3. The pair of sheet-discharging rollers 3 discharges the sheet onto the stacking tray 4.

Joggers 5 align the side edges of the sheets along the sheet conveying direction (lateral alignment). A paddle 6 brings the sheet into abutment with a reference wall 10, which corresponds to sheet receiving means, to align the trailing ends of the sheets. The abutment reference wall 10 for aligning in the conveying direction is formed in the vicinity of the intermediate roller 2, which will be described later, and abutment reference wall 10 is on the downstream side of the intermediate roller 2 so as to extend substantially vertically from a lower conveying guide 9*b*, which will be described later, toward the intermediate roller 2.

An intermediate stacking station D is a portion including the intermediate roller 2, the paddle 6, and the stapler. An aligning unit E is a portion including the joggers 5.

FIG. 2 is a drawing illustrating the operation of a simple stacking mode, which corresponds to a first processing mode. An upper sheet-discharging roller 3*a* of the pair of discharging rollers 3 is moved downward with respect to a lower sheet-discharging roller 3*b*. In this state, the single sheet C received from the image forming apparatus A passes through the pair of entrance rollers 1 and the intermediate roller 2, and is then discharged and stacked onto the stacking tray 4 by the pair of sheet-discharging rollers 3 without stopping at the intermediate stacking station D. The pair of sheet-discharging rollers 3 is an example of sheet-discharging means. The upper sheet-discharging roller 3*a* is an example of an upper sheet-discharging rotating member. The lower sheet-discharging roller 3*b* is an example of a lower sheet-discharging rotating member.

Figure 3:
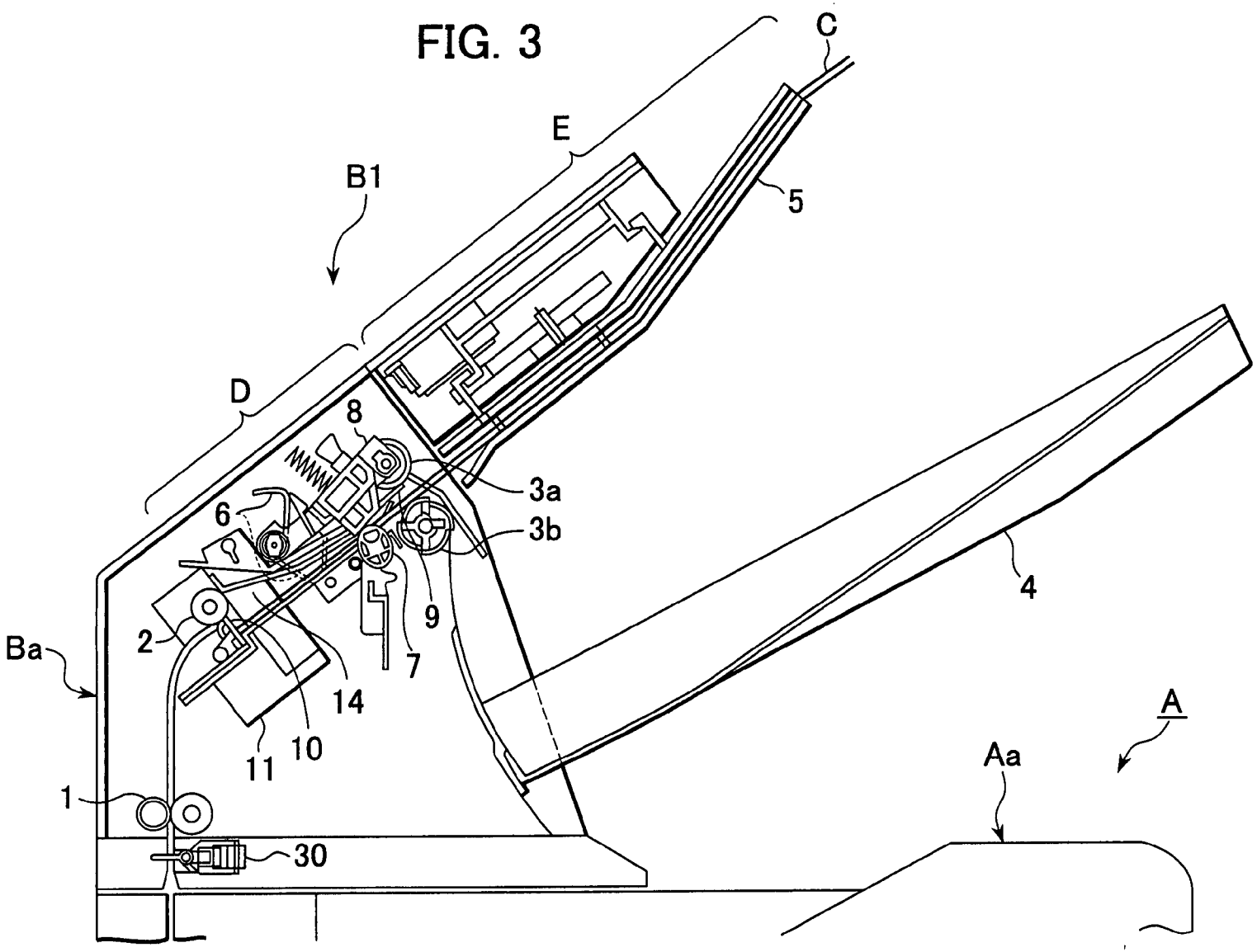
FIG. 3 is a drawing illustrating the operation of a sheet processing mode, which corresponds to a second processing mode.

FIG. 3 is a drawing illustrating the operation of the sheet processing mode, which corresponds to the second processing mode. The upper sheet-discharging roller 3*a* of the pair of sheet-discharging rollers 3 is moved away from the lower sheet-discharging roller 3*b*. In this state, the single sheet C received from the image forming apparatus A passes through the pair of entrance rollers 1 and the intermediate roller 2, and is guided to the joggers 5. The sheet C, after having passed through the intermediate roller 2 completely, is returned in the direction opposite to the sheet conveying direction by the paddle 6, which may correspond to returning means, which is rotated from a position indicated by the solid line to a position indicated by the broken line clockwise, and then is brought into abutment with the reference wall 10 so that the trailing ends of the sheets are aligned (vertical alignment).

When the upstream side of the lower conveying guide 9*b* (See FIG. 4) is lower than the downstream side, the sheet may be able to slide on the lower conveying guide by its own weight toward the upstream side and is brought into abutment with the reference wall 10. Therefore, the paddle 6 is not necessarily required. However, alignment of the trailing end of the sheet can be reliably performed if the paddle 6 is provided.

Subsequently, the sheet C is laterally aligned by the joggers 5, which can be moved between the near side and the far side in the drawing, and are aligned to a predetermined position. The sheet processing device B1 performs the same aligning operation at the intermediate stacking station D for the subsequent sheets, and after having finished alignment of the desired number of sheets, staples the trailing end of the sheets using sheet processing means, such as the stapler 11, which is disposed in the vicinity of the intermediate roller 2 on the downstream side in the sheet conveying direction.

Figure 4:
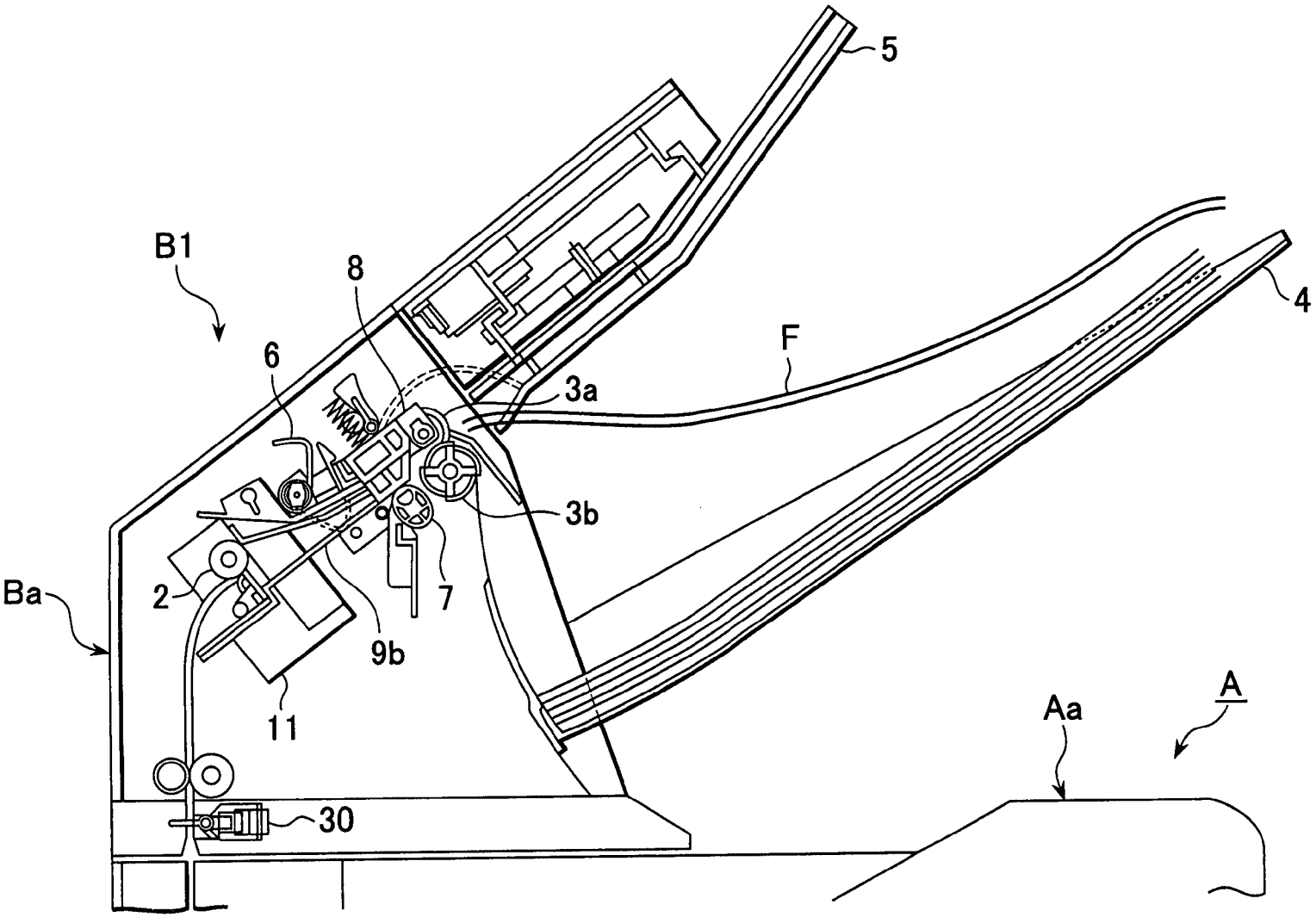
FIG. 4 is a drawing of the sheet processing device shown in FIG. 2, showing a state in which the stapled sheets are being discharged.

Subsequently, as shown in FIG. 4, the stapled bundle of sheets F is clamped between the upper sheet-discharging roller 3*a* and the lower sheet-discharging roller 3*b* by the second downward movement of the upper sheet-discharging roller 3*a*, and is discharged and stacked on the stacking tray 4 by the rotation of the pair of sheet-discharging rollers 3.

Referring now to perspective views of the sheet processing device shown in FIG. 5 to FIG. 8, the operation of the joggers 5 and the sheet-discharging operation will be described.

Figure 5:
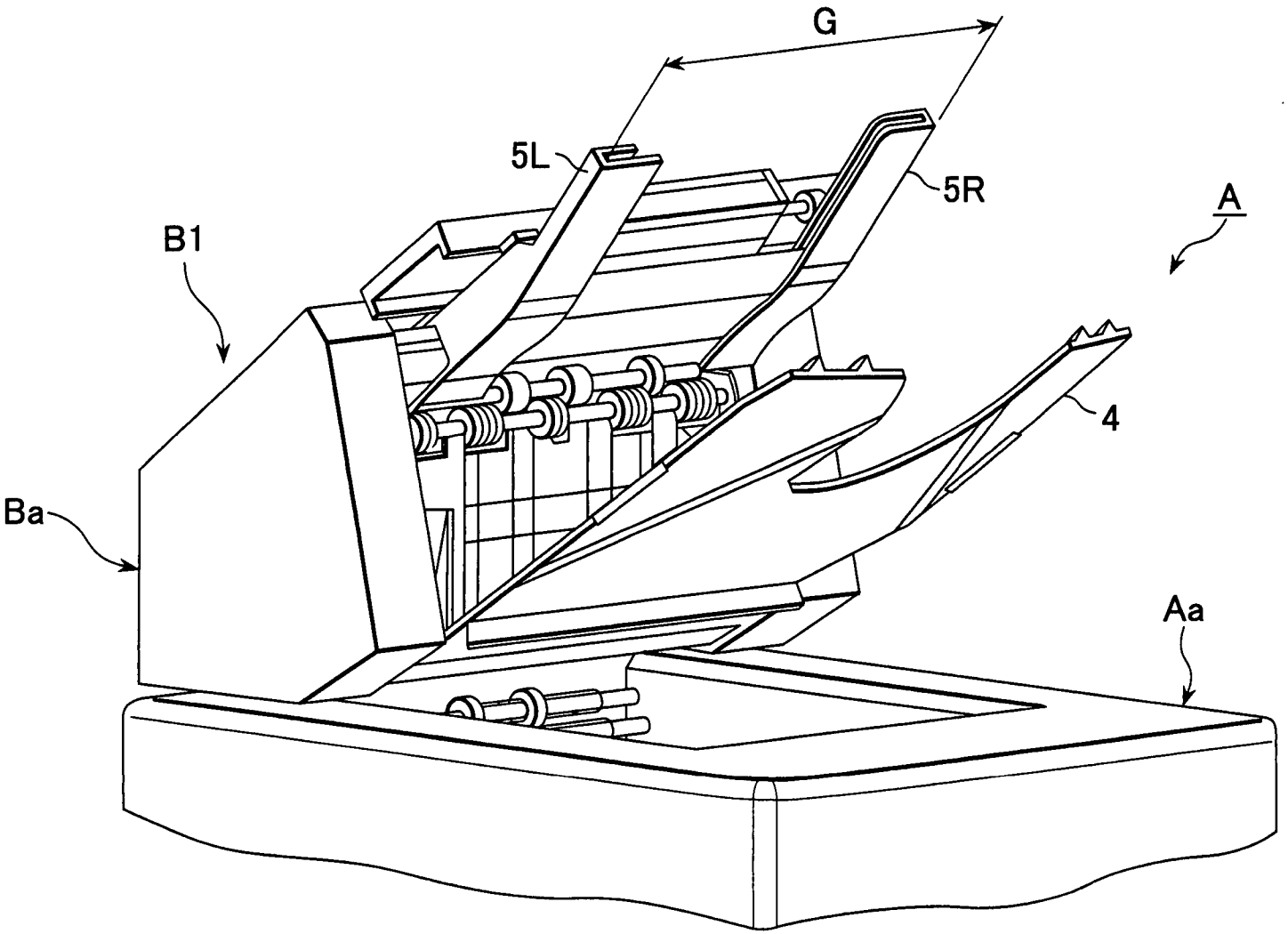
FIG. 5 shows the sheet processing device shown in FIG. 2 in the sheet processing mode, which corresponds to the second processing mode.
Figure 6:
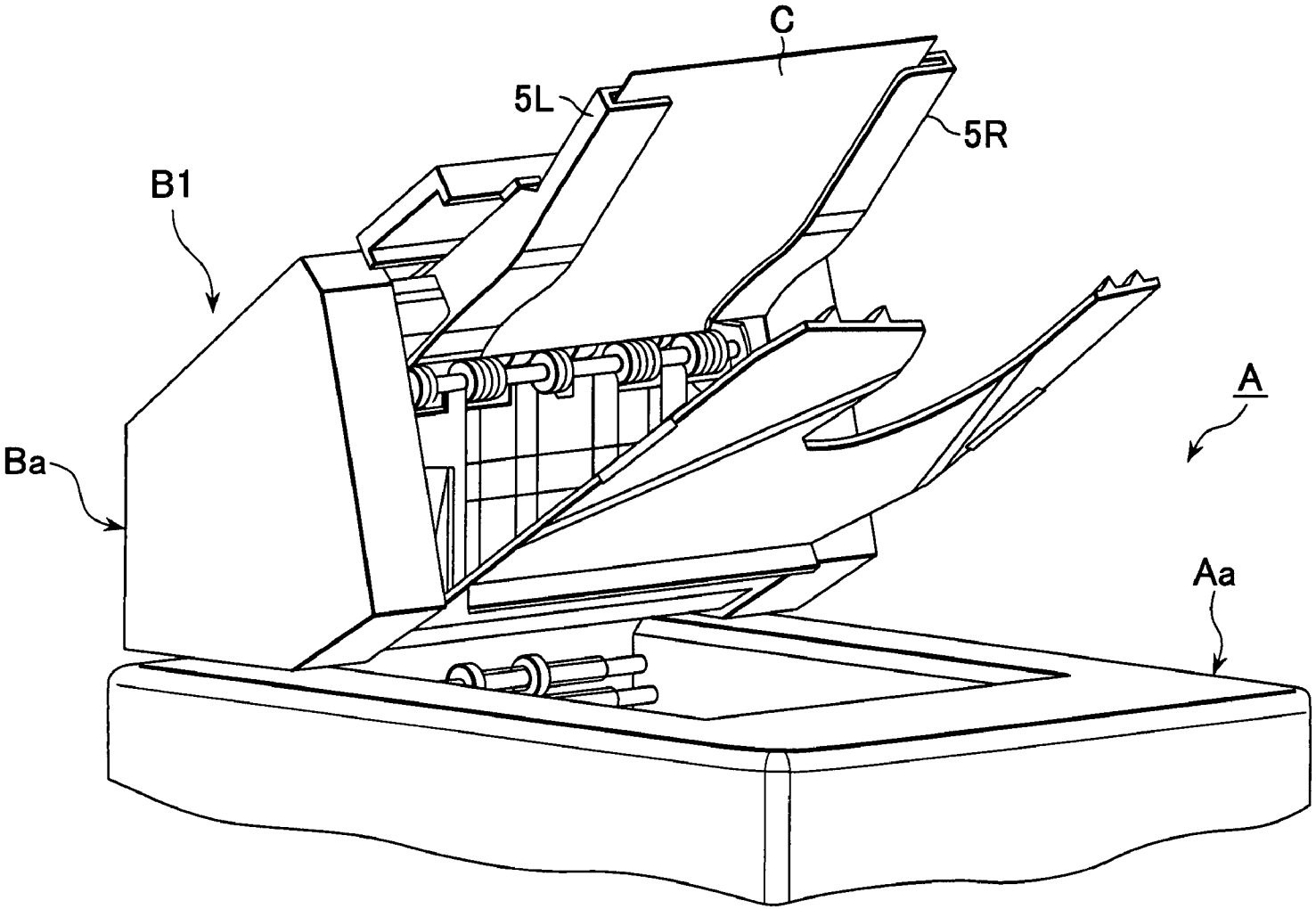
FIG. 6 is a drawing of the sheet processing device shown in FIG. 2 in the sheet processing mode, which corresponds to the second processing mode, in a state in which the sheets are held by left and right joggers.

The sheet processing device B1 shown in FIG. 5 is ready for the sheet processing mode, which corresponds to the second processing mode described above. One jogger 5L of the pair of joggers 5 waits in an open state at a distance G from jogger 5R, which is enough to receive the sheet, with respect to the other jogger 5R. The sheets discharged from the main body Aa of the printer A enter between the joggers 5, and are supported by the left and right joggers 5L and 5R, as shown in FIG. 6. Then, the supplied sheets are aligned, processed, and discharged in bundles.

Figure 7:
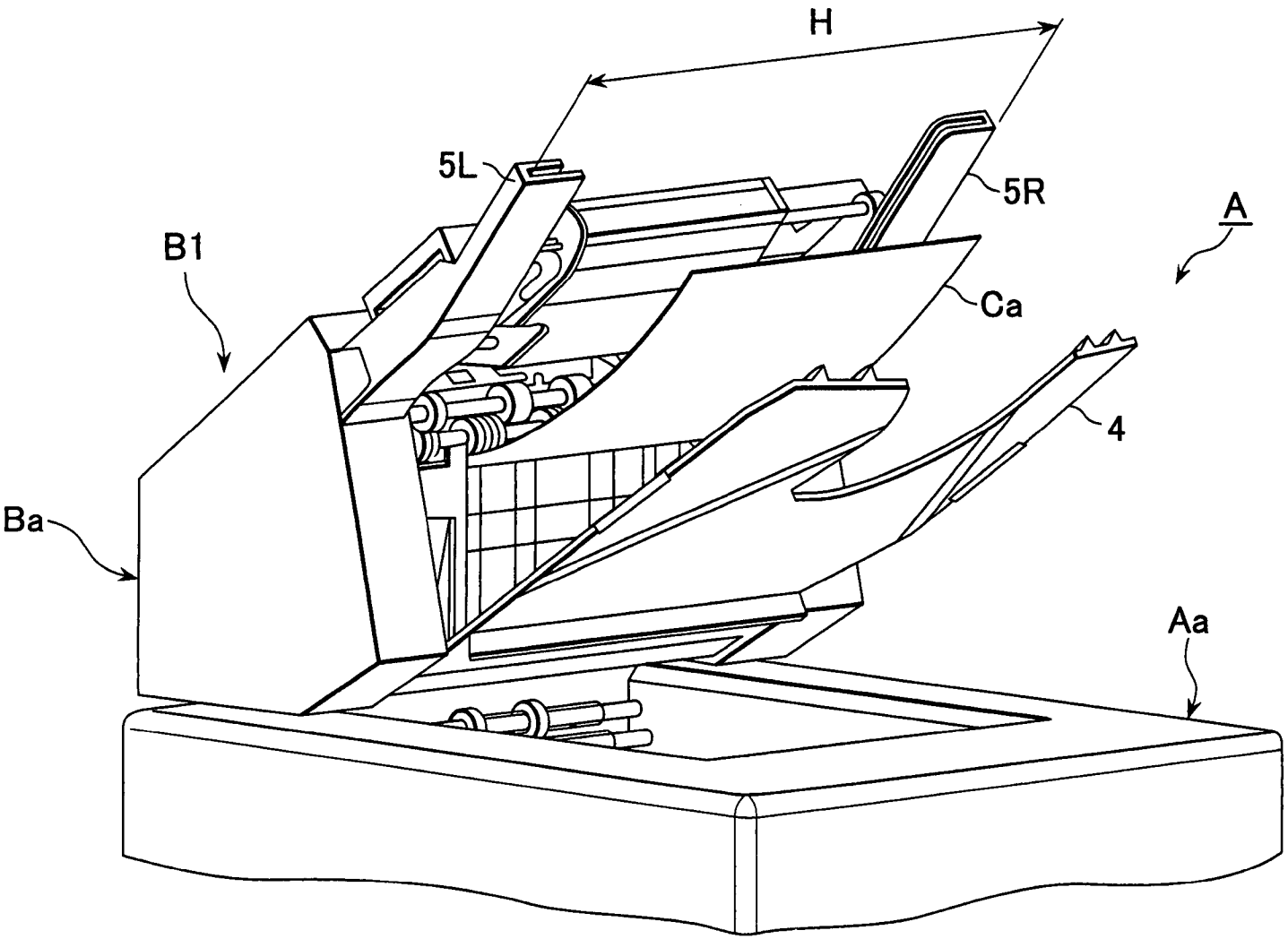
FIG. 7 is a drawing of the sheet processing device shown in FIG. 2 in the sheet processing mode, which corresponds to the second processing mode, in a state in which the distance between the left and right joggers increases to drop the sheet.
Figure 8:
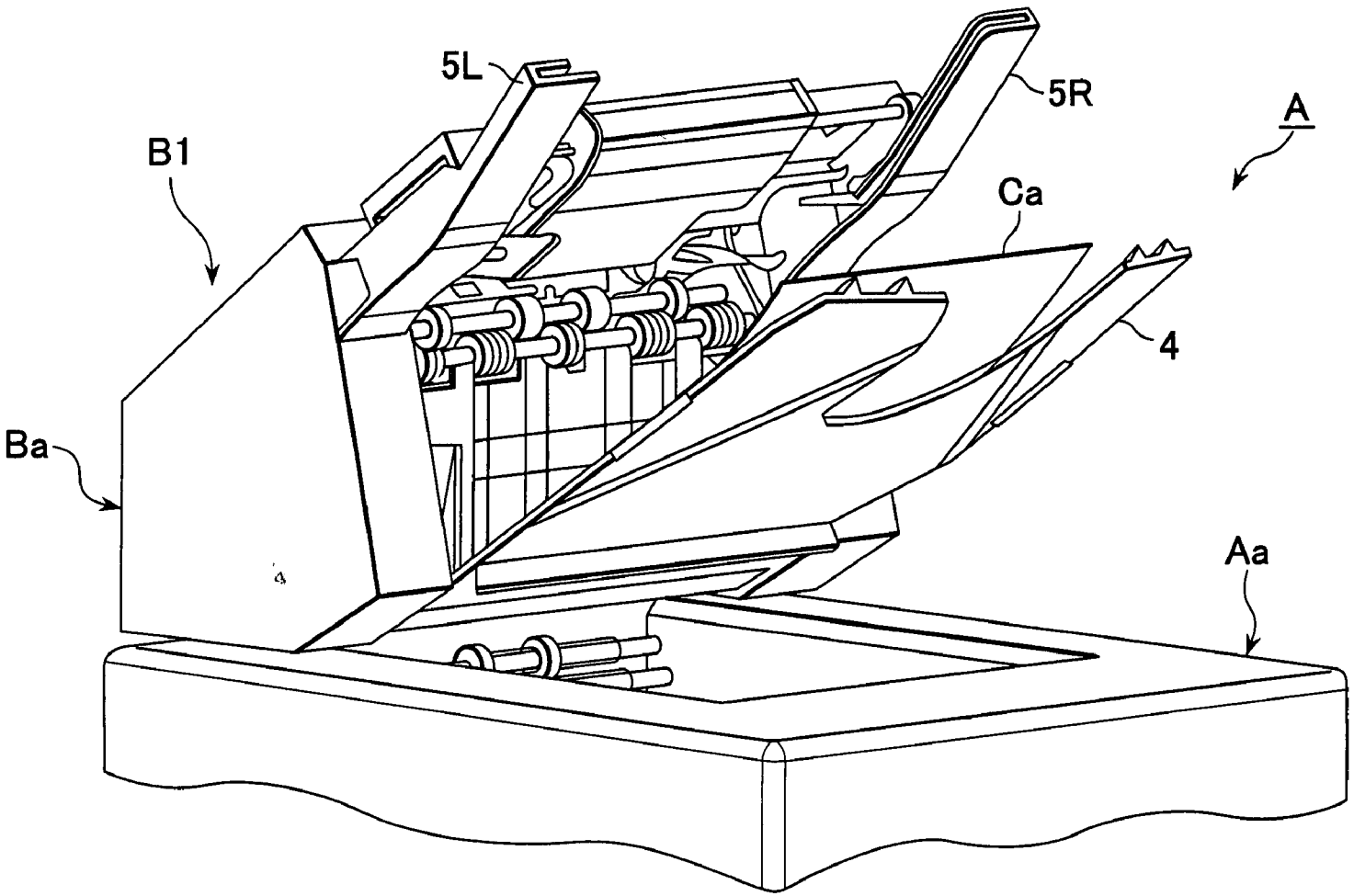
FIG. 8 is a drawing of the sheet processing device shown in FIG. 2 in the sheet processing mode, which corresponds to the second processing mode, in a state in which the distance between the left and right joggers increases and thus the sheet is dropped on a stacking tray.

When the joggers 5L and 5R are opened to a distance H (FIG. 7), which is wider than the width of the sheet (the direction intersecting the sheet conveying direction), the sheet Ca drops onto the stacking tray 4 and is stacked as shown in FIG. 7 and FIG. 8.

The mechanism of the pair of sheet-discharging rollers 3 and the upper conveying guide 9*a* will now be described in further detail.

Figure 9:
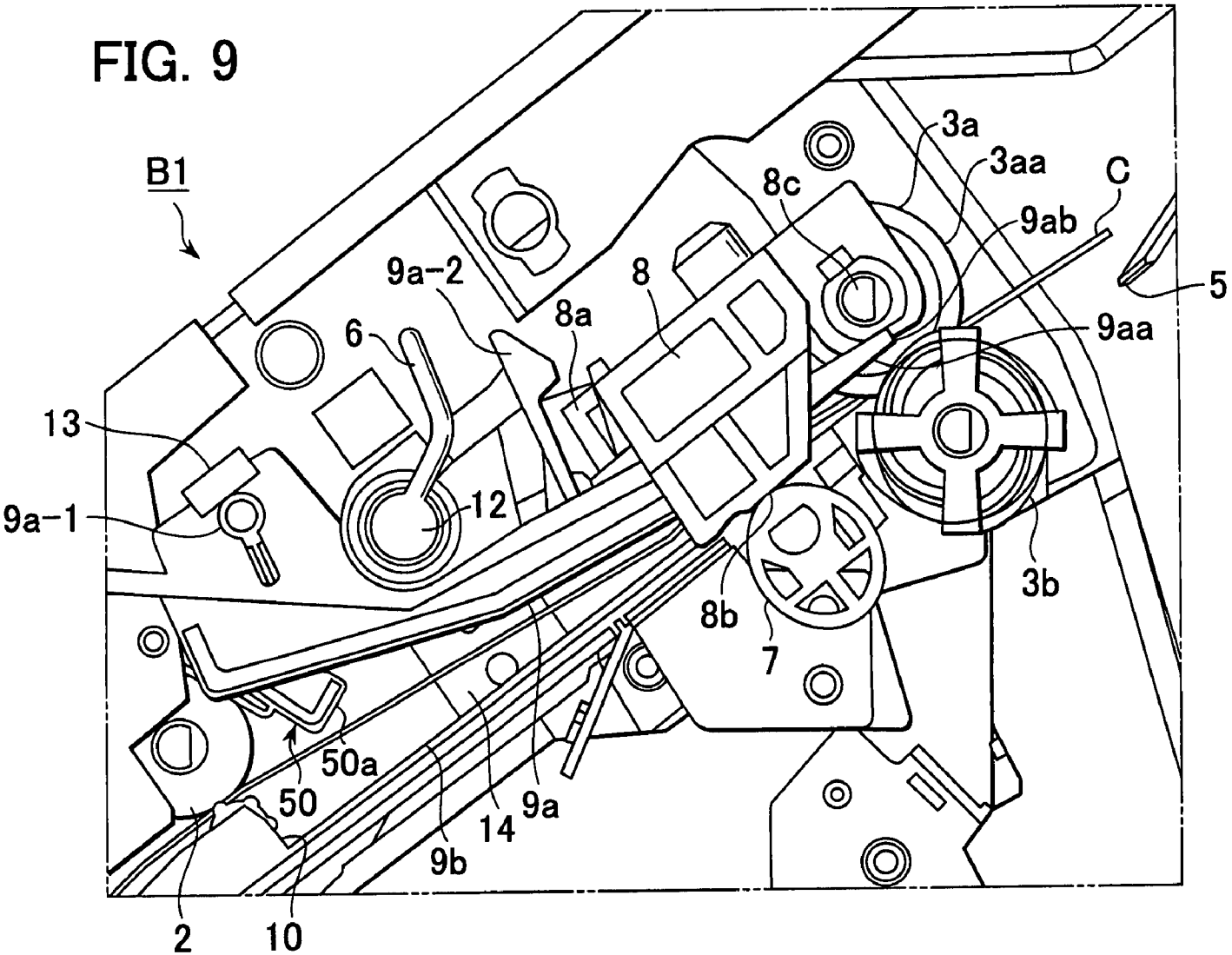
FIG. 9 is an enlarged drawing of a portion around a pair of sheet-discharging rollers and an upper conveying guide of the sheet processing device shown in FIG. 2, in the simple stacking mode, which corresponds to the first processing mode.

FIG. 9 is an enlarged view of the portion around the pair of sheet-discharging rollers 3 and the upper conveying guide 9*a* of the sheet processing device B1 in the first processing mode.

As described above, in the simple stacking mode, the sheet fed from the main body Aa of the printer A into the intermediate stacking station D passes through the intermediate stacking station D and is discharged onto the stacking tray 4.

The upper sheet-discharging roller 3*a* is rotatably supported by an arm member, such as a bearing 8*c* of an arm 8. The arm 8 is rotatably supported by a fulcrum shaft 12 provided on the casing unit Ba. The upper conveying guide 9*a* guides the upper surface of the sheet and is supported by the fulcrum shaft 12, which is the same as the fulcrum shaft 12 of the arm 8, so as to be capable of rotating in the vertical direction. The lower conveying guide 9*b* supports and guides the lower surface of the sheet. The upper conveying guide 9*a* and the lower conveying guide 9*b* constitute part of the intermediate stacking station D. The upper conveying guide 9*a* and the lower conveying guide 9*b* are an example of guiding means.

The upper conveying guide 9*a* is stopped at a home position in the figure by a stopper pin 9*a*-1 formed on the upper conveying guide 9*a*, which is abutted against a stopper 13 on the casing unit Ba, as shown in FIG. 9. A link lever 9*a*-2 is formed so as to project on the upper side of the upper conveying guide 9*a*. The link lever 9*a*-2 is located away from a link portion 8*a* formed on the arm 8 in the state shown in FIG. 9. Accordingly, the arm 8 and the upper conveying guide 9*a* are not interlocked. The link lever 9*a*-2 and the link portion 8*a* are an example of interlocking means and also an example of an abutting portion.

Elevating means, such as a cam 7, is constantly kept in contact with a lower surface 8*b* of the arm 8. The cam 7 shown in FIG. 9 is stopped by the arm 8 and the upper sheet-discharging roller 3*a*, which is rotatably supported by the arm 8, which are lowered to their lowermost positions.

A plurality of upper sheet-discharging rollers 3*a* and lower sheet-discharging rollers 3*b* are disposed alternately in the direction of the axis of rotation. Therefore, when the cam 7 is in the lowered position shown in FIG. 9, the upper sheet-discharging rollers 3*a* and the lower sheet-discharging rollers 3*b* enter the spaces formed between the rollers on the other side, clamp the sheet in a wavy form, and rotate in the sheet conveying direction. In this case, peripheral surfaces 3*aa* of the upper sheet-discharging rollers 3*a* project downward with respect to a sheet guiding surface 9*aa* on the lower surface of the upper conveying guide 9*a*.

Therefore, the sheet going into the peripheral surfaces of the pair of sheet-discharging rollers 3 is conveyed through the nips between the upper sheet-discharging rollers 3*a*, which are moved downward while rotating, and the lower sheet-discharging rollers 3*b* in a wavy form, and is simply discharged onto the stacking tray 4 as is. Although the plurality of upper sheet-discharging roller 3*a* and lower sheet-discharging rollers 3*b* are disposed alternately in the direction of the axis of rotation in this example, it is also possible not to arrange these rollers alternately, but instead to arrange them at positions where they contact each other, and convey and discharge the sheet in a flat form, not in a wavy form.

Figure 10:
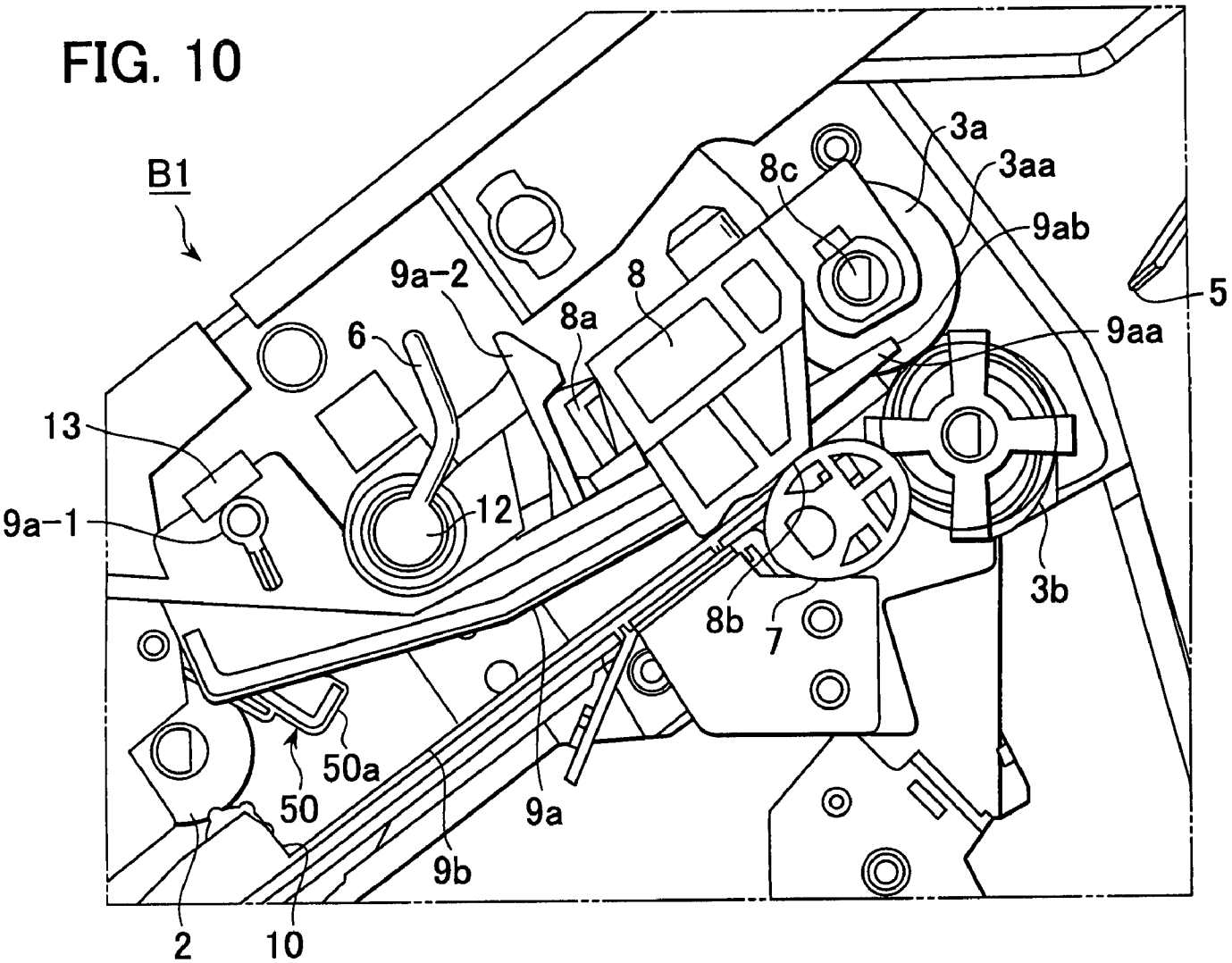
FIG. 10 is a drawing showing a state in which a cam starts rotating counter-clockwise in FIG. 9.
Figure 11:
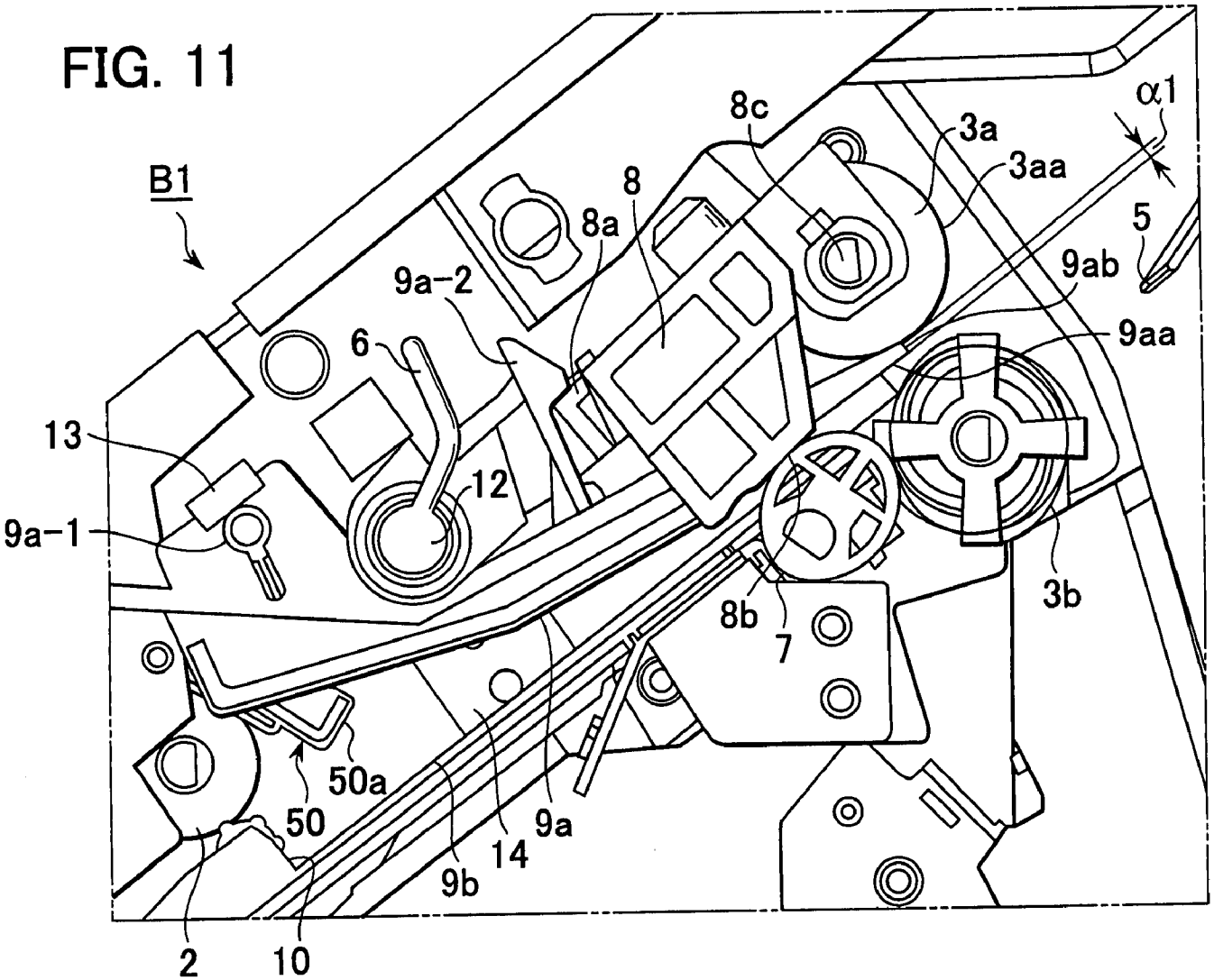
FIG. 11 is a drawing showing a state in which the cam is rotated further counter-clockwise from the state shown in FIG. 10.
Figure 12:
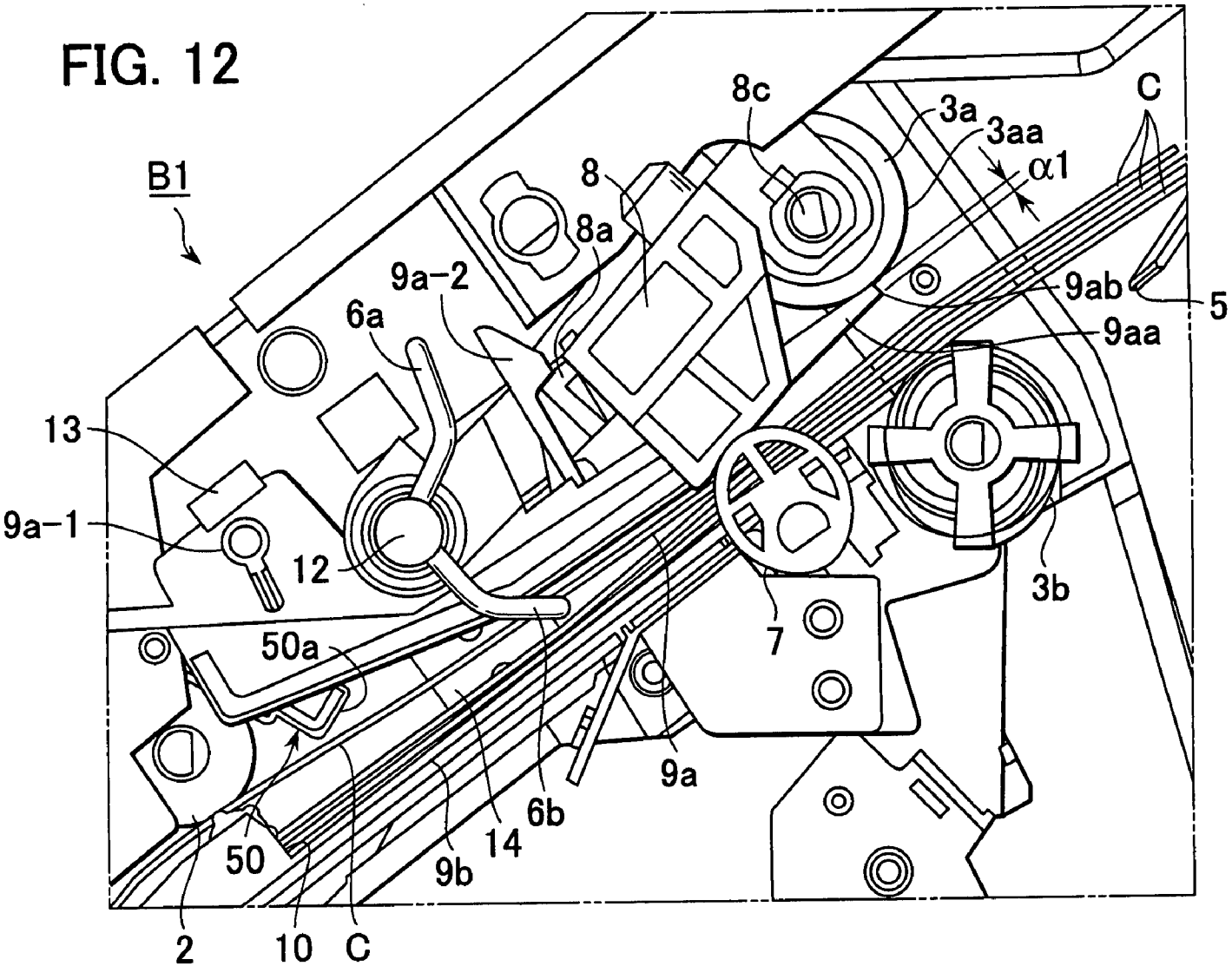
FIG. 12 is a drawing showing a state in which the cam is rotated further counter-clockwise from the state shown in FIG. 11.

FIGS. 10 to 12 are explanatory drawings illustrating the operation of the arm 8 and the upper conveying guide 9*a* when the cam 7 rotates counterclockwise in the figure. FIG. 10 shows a state in which the cam 7 starts rotating counterclockwise. The distance of elevation of the upper sheet-discharging roller 3*a* moved upward by the arm 8 is set to a distance larger than the distance of upward rotation of the upper conveying guide 9*a*.

The arm 8 is pressed upward against the lower surface 8*b* by the rotation of the cam 7, and the arm 8 starts to rotate upward about the fulcrum shaft 12. In this case, the upper sheet-discharging roller 3*a*, which is rotatably supported by the arm 8, move upward integrally with the arm 8 and start to move away from the lower sheet-discharging roller 3*b*. However, the upper conveying guide 9*a*, which is rotatably supported by the same fulcrum shaft 12 as the arm 8, is not yet interlocked with the arm 8 (not ready for starting linking) since a gap still remains between the link portion 8*a* of the arm 8 and the link lever 9*a*-2. Therefore, only the arm 8 and the upper sheet-discharging rollers 3*a* continue to move upward away from the lower sheet-discharging rollers 3*b*. In this stage, the peripheral surfaces 3*aa* of the upper sheet-discharging roller 3*a* projects downward from the sheet guiding surface 9*aa* of the upper conveying guide 9*a*.

FIG. 11 shows a state in which the cam 7 further rotates counterclockwise in the figure. Rotation of the cam 7 brings the link portion 8*a* of the arm 8 into contact with the link lever 9*a*-2 of the upper conveying guide 9*a*, and the upper conveying guide 9*a* is moved upward in association with upward rotation of the arm 8 from then on. In other words, the arm 8 and the upper conveying guide 9*a* are linked. In this stage, the peripheral surfaces 3*aa* of the upper sheet-discharging rollers 3*a* are moved upward by a distance α1 from the sheet guiding surface 9*aa* of the upper conveying guide 9*a*. From then on, the upper sheet-discharging rollers 3*a* and the upper conveying guide 9*a* rotate upward while maintaining in this positional relationship (linked state). The upper sheet-discharging rollers 3*a* move away from the lower sheet-discharging rollers 3*b*, and the upper conveying guide 9*a* moves away from the lower conveying guide 9*b*.

FIG. 12 is a drawing showing a state in which the cam 7 rotates further counterclockwise in the figure. The arm 8 and the upper sheet-discharging rollers 3*a* terminate rotation in the state shown in FIG. 12. In this case as well, as in the case of FIG. 11, the peripheral surface 3*aa* of the upper sheet-discharging roller 3*a* is moved upward by a distance α1 from the sheet guiding surface 9*aa* of the upper conveying guide 9*a*. In this manner, the sheet processing device B1 receives a sheet from the image forming apparatus in a state in which the peripheral surfaces 3*aa* of the upper sheet-discharging rollers 3*a* are moved upward from the sheet guiding surface 9*aa* of the upper conveying guide 9*a*, the upper sheet-discharging rollers 3*a* are moved away from the lower sheet-discharging rollers 3*b* to the largest extent possible, and the upper conveying guide 9*a* is separated from the lower sheet-discharging roller 3*b* to the maximum extent possible.

The interlocking mechanism (linking structure) between the arm 8 and the upper conveying guide 9*a* in which the positional relationship between the peripheral surfaces 3*aa* of the upper sheet-discharging rollers 3*a* and the sheet guiding surface 9*aa* of the upper conveying guide 9*a* is inverted when the upper sheet-discharging rollers 3*a* are moved upward and the upper sheet-discharging rollers 3*a* are completely moved away from the lower sheet-discharging rollers 3*b* in the sheet processing device B1 of the present embodiment has been described thus far.

In the sheet processing mode, the fed sheet C passes through the intermediate roller 2 and is stacked on the lower conveying guide 9*b*, which is the intermediate stacking station D. Then, the paddle 6 rotates clockwise from a position indicated by a reference numeral 6*a* to a position indicated by a reference numeral 6*b* in FIG. 12, is brought into contact with the sheet at the position indicated by the reference numeral 6*b*, and moves the sheet toward the upstream side in the sheet conveying direction. The paddle 6 performs vertical alignment of the sheets by bringing the trailing end of the sheet into abutment with the reference wall 10. Subsequently, the paddle 6 continues clockwise rotation, and then returns to the home position 6*a*. After the trailing ends of the sheets are brought into abutment with the reference wall 10, the sheets are laterally aligned by the joggers 5.

The sheet processing device B1 repeats the operations described above sequentially to perform alignment of a predetermined number of sheets. Then, the predetermined number of sheets are stapled with the stapler 11 into a bundle.

Subsequently, the cam 7 continues its counterclockwise rotation and rotates from the position shown in FIG. 12 to the original position shown in FIG. 9, so that the arm 8 and the upper sheet-discharging roller 3*a* are lowered. In association with this movement, the upper conveying guide 9*a* rotates downward as well, and stops at a position no lower than the peripheral surfaces 3*aa* of the upper sheet-discharging rollers 3*a*. Then the pair of sheet-discharging rollers 3 discharges and stacks the bundle of sheets on the stacking tray 4.

Figure 13:
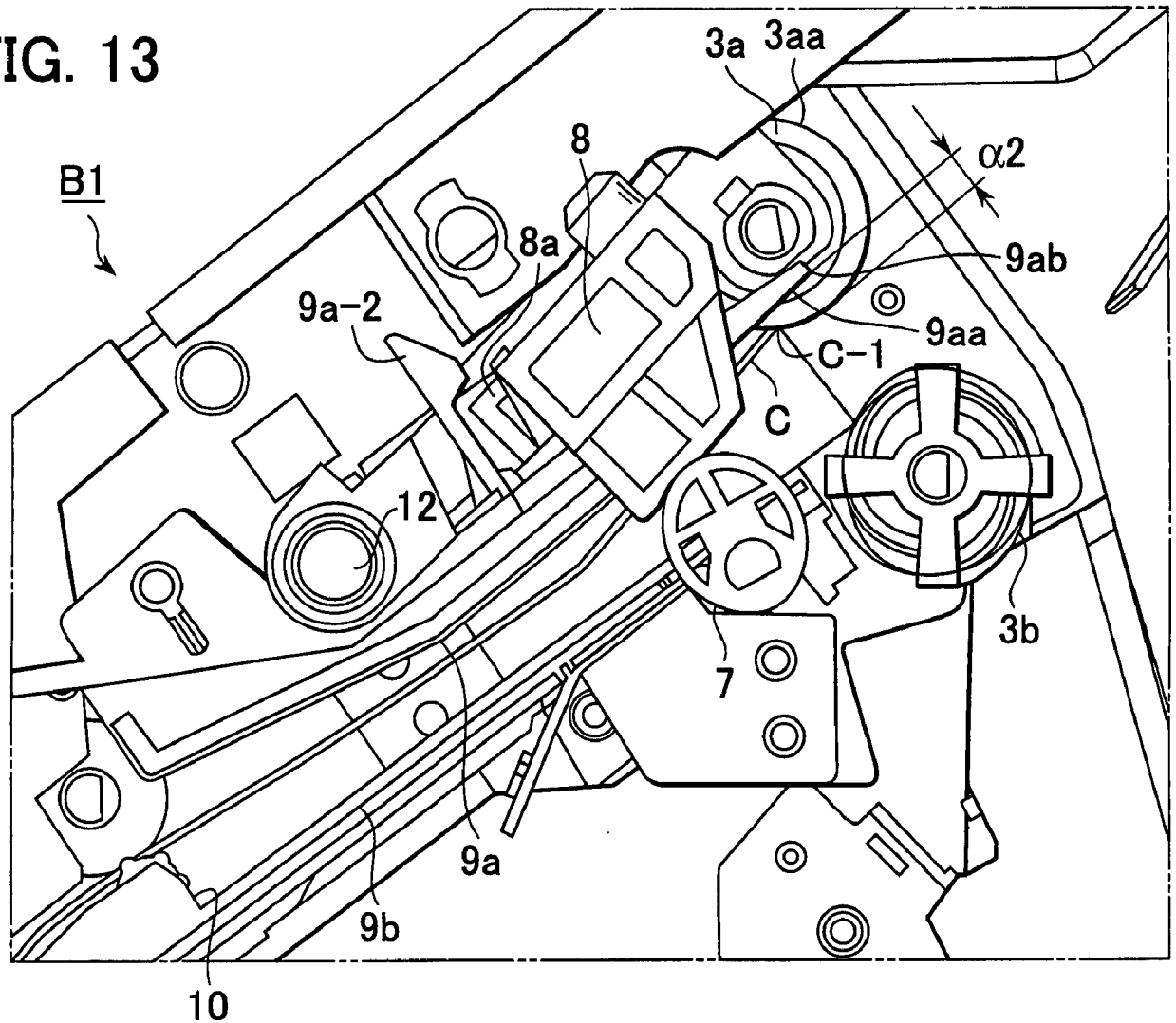
FIG. 13 is a drawing illustrating the relative positional relationship between an upper sheet-discharging roller and the upper conveying guide when the upper sheet-discharging roller is moved upward and the sheet cannot be conveyed smoothly.

FIG. 13 is a drawing illustrating the relative positional relationship between the upper sheet-discharging rollers 3*a* and the upper conveying guide 9*a* when the sheet cannot be conveyed smoothly in the case where the upper sheet-discharging rollers 3*a* are moved upward.

FIG. 13 shows a state in which the upper sheet-discharging rollers 3*a* have completely moved away from the lower sheet-discharging rollers 3*b*, with the peripheral surface 3*aa* of the upper sheet-discharging rollers 3*a* being projected downward by a distance α2 from the sheet guiding surface 9*aa* of the upper conveying guide 9*a*. The sheet C fed in this state may not be conveyed smoothly because a leading end C-1 becomes trapped on the peripheral surfaces 3*aa* of the upper sheet-discharging rollers 3*a* and may become jammed between the upper conveying guide 9*a* and a lower conveying guide 9*b*. However, according to the sheet processing device B1 of the present embodiment, since the sheet guiding surface 9*aa* of the upper conveying guide 9*a* is positioned at a level lower than the peripheral surfaces 3*aa* of the upper sheet-discharging rollers 3*a*, as described above, the sheet will never become trapped between the upper conveying guide 9*a* and the lower conveying guide 9*b*.

Referring now to FIGS. 14 to 21, the sheet lift preventing member in the sheet processing device according to the first embodiment will be described in detail.

Figure 14:
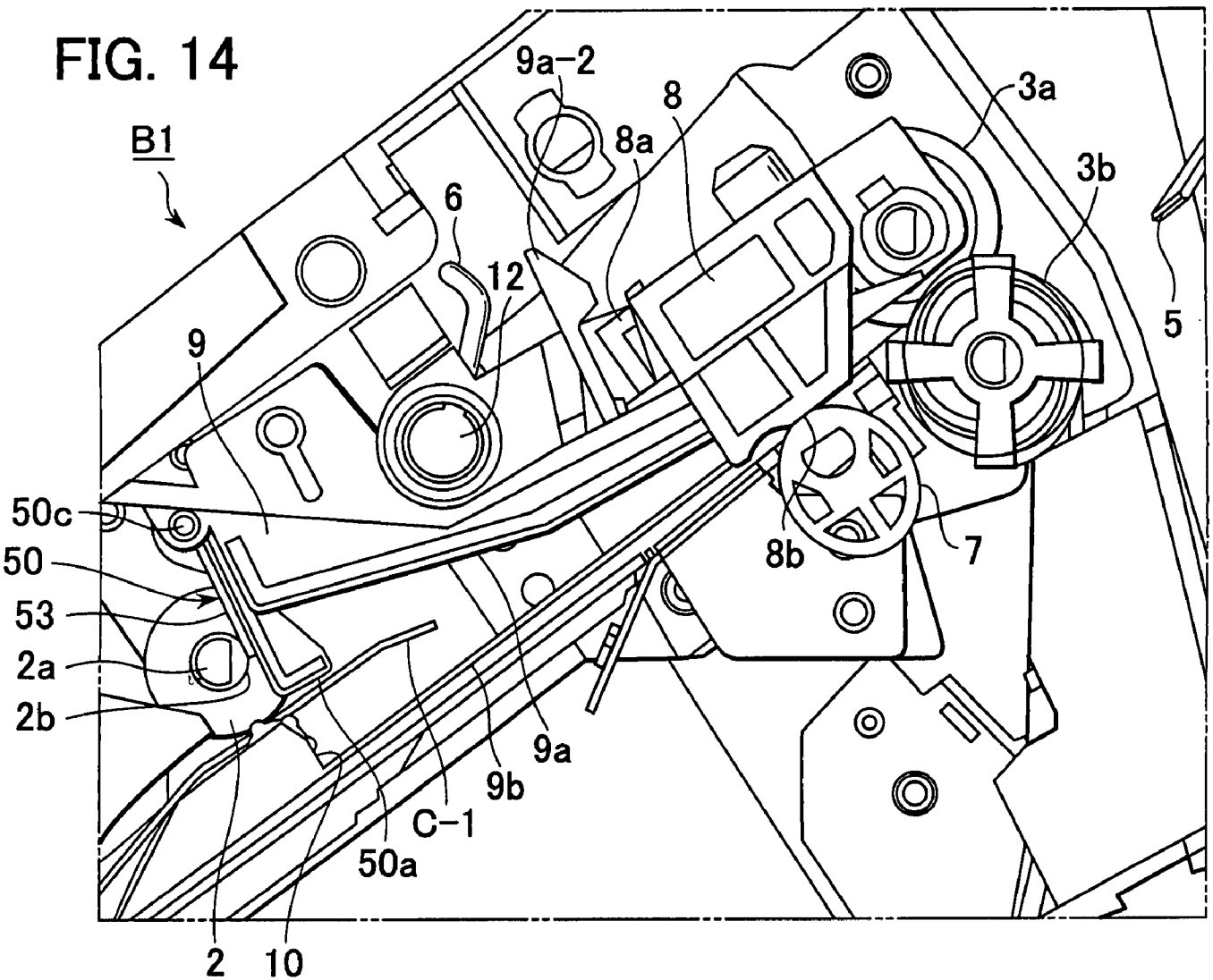
FIG. 14 is a view of the sheet processing device shown in FIG. 2 with a sheet lift preventing member added, and is an enlarged view of the portion around the pair of sheet-discharging rollers and the upper conveying guide in the simple stacking mode, which corresponds to the first processing mode.

FIG. 14 is an enlarged front view showing a principal portion of the sheet processing device B1 in the simple stacking mode, which corresponds to the first processing mode.

In this simple stacking mode, as described in conjunction with FIGS. 1 to 13, the arm 8, a distal end 9*ab*, which is the downstream end of the upper conveying guide 9*a* interlocked thereto, and the upper sheet-discharging roller 3*a* are at lowered positions. A sheet lift preventing member 50, which is a rotating member, is rotatably supported by a fulcrum shaft 50*c* on the upper conveying guide 9*a* so as to be capable of rotating in the vertical direction. The fulcrum shaft 50*c*, which corresponds to the center of rotation of the rotating member, is provided on the upstream side of the fulcrum shaft 12 of the upper conveying guide 9*a* in the sheet conveying direction. Therefore, the upstream portion of the upper conveying guide 9*a* with respect to the fulcrum shaft 12 in the sheet conveying direction and the fulcrum shaft 50*c* perform the vertical movement in the direction opposite to the upper sheet-discharging roller 3*a* and the distal end 9*ab* of the upper conveying guide 9*a*. In other words, the upstream portion of the upper conveying guide 9*a* with respect to the fulcrum shaft 12 in the sheet conveying direction and the fulcrum shaft 50*c* move upward when the upper sheet-discharging rollers 3*a* move downward in the first processing mode (simple stacking mode), and move downward when the upper sheet-discharging rollers 3*a* move upward in the second processing mode (sheet processing mode).

Figure 15:
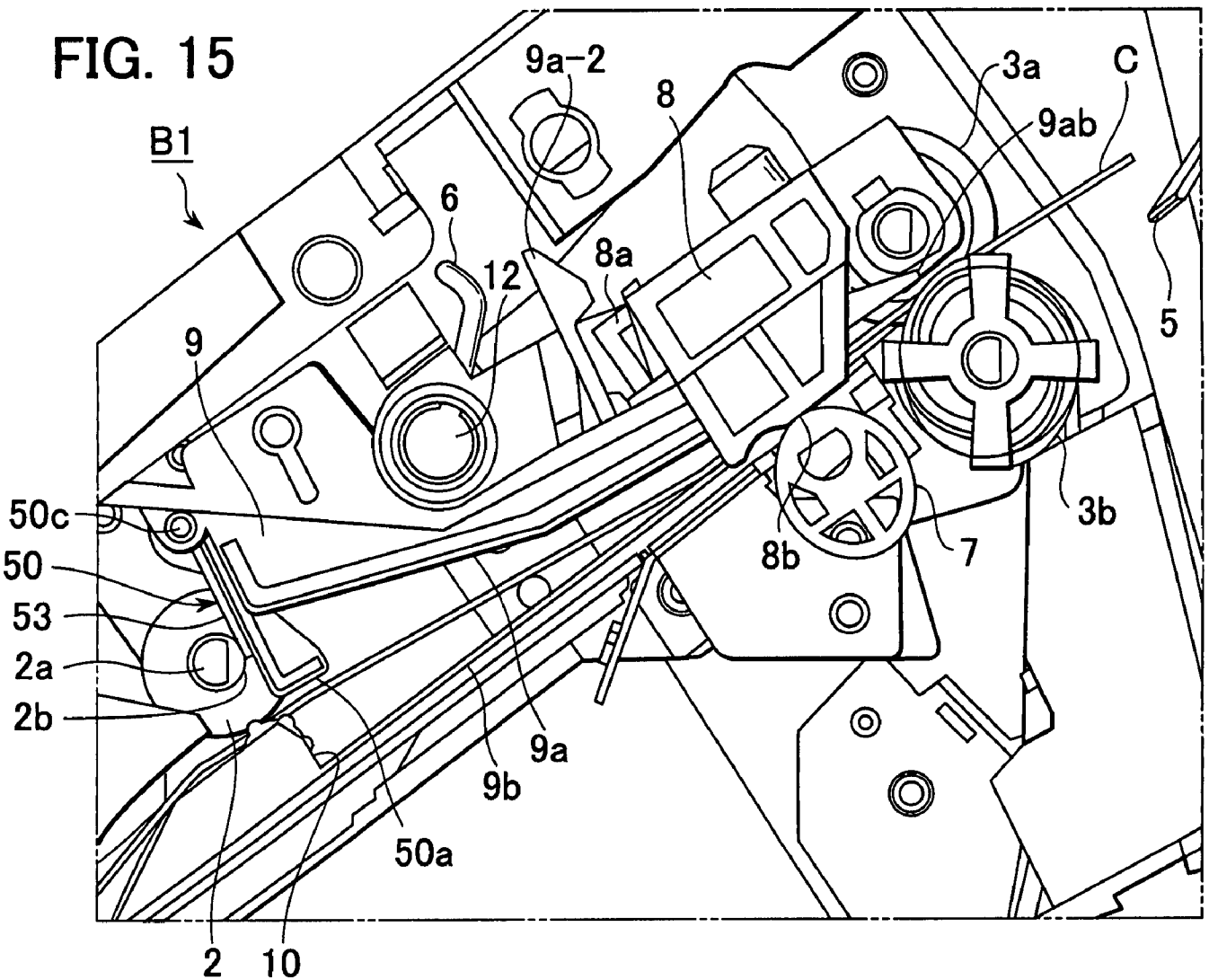
FIG. 15 is a drawing showing a state in which the sheet is conveyed from the state shown in FIG. 14, and the leading end of the sheet reaches the downstream side of the upper sheet-discharging roller and the lower sheet-discharging roller.

In FIG. 14 and FIG. 15, the state of the sheet C in the simple stacking mode is shown. In the simple stacking mode, the upper sheet-discharging rollers 3*a* are at the lowered position, and the sheet C passes through the intermediate stacking station D as is and is discharged therefrom. At this moment, the sheet lift preventing member 50 is at the elevated position, which corresponds to the opposite side of the lowered upper sheet-discharging rollers 3*a*. Therefore, as shown in FIG. 14 and FIG. 15, the sheet discharged from the intermediate roller 2 is not brought into abutment with the sheet lift preventing member 50, and instead passes under the sheet lift preventing member 50. The intermediate roller 2 clamps and carries the sheet in cooperation with an intermediate roller 66 shown in FIG. 22. The intermediate roller 2 and the intermediate roller 66 constitute a pair of intermediate rollers 67. The pair of intermediate rollers 67 may serve as sheet-conveying means, and is an example of a pair of sheet-conveying rotating members.

In FIG. 14 and FIG. 15, the sheet lift preventing member 50 is rotationally urged clockwise by an urging spring 51, which will be described later, and a surface 53 provided integrally with the sheet lift preventing member 50 is in contact with, and supported by, the peripheral surface 2*b* of the shaft 2*a* of the intermediate roller 2. Accordingly, the sheet lift preventing member 50 is positioned in the vicinity of the nip between the pair of intermediate rollers 67 constructed of the intermediate roller 2 and the intermediate roller 66.

Figure 16A:
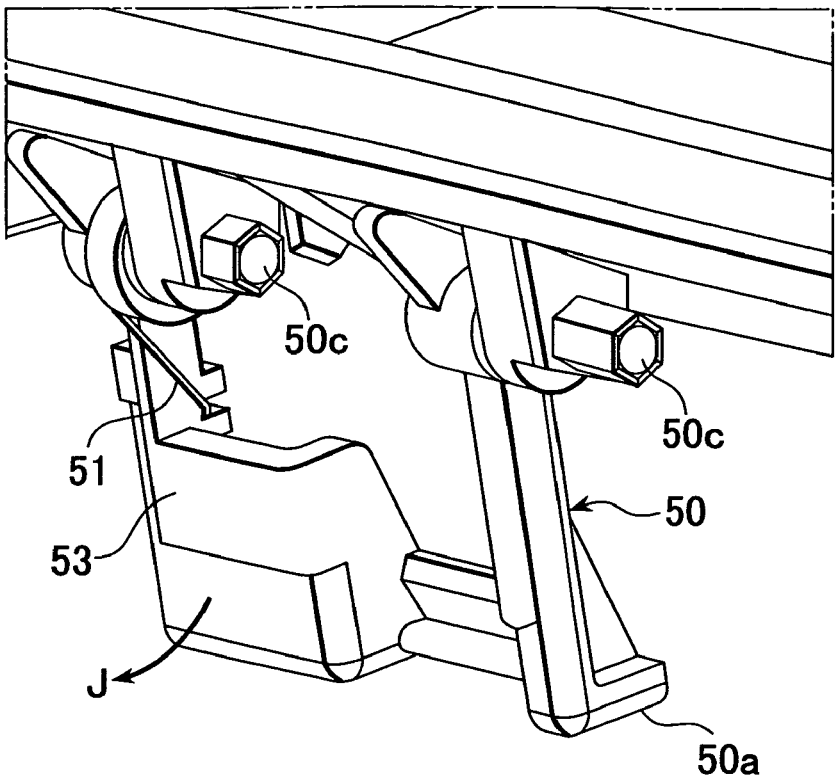
FIG. 16 is a perspective view of the sheet lift preventing member shown in FIG. 14, in which the FIG. 16A is a drawing showing a state in which the sheet lift preventing member is lowered.
FIG. 16B is a drawing showing a state in which the sheet lift preventing member is pressed and rotated in the direction indicated by an arrow K (downstream side in the sheet conveying direction) by a sheet, not shown in the figure.
Figure 16B:
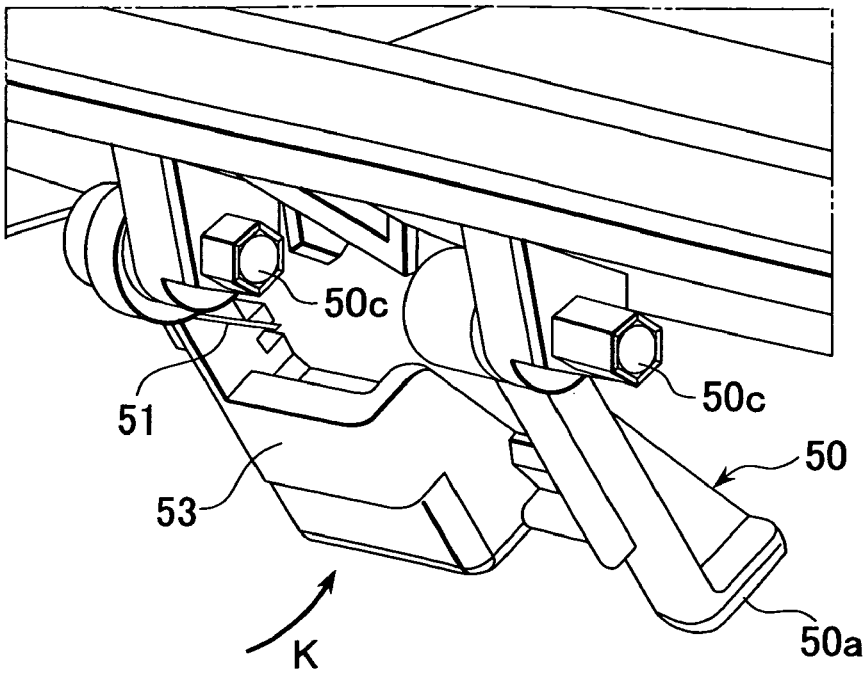

FIG. 16A and FIG. 16B are enlarged perspective views of the sheet lift preventing member 50. The sheet lift preventing member 50 is rotatably supported by the fulcrum shaft 50*c* of the upper conveying guide 9. The sheet lift preventing member 50 is urged in a direction indicated by an arrow J (upstream side in the sheet conveying direction) by the urging spring 51, so that the lower end thereof 50*a* approaches the sheet and holds the sheet.

In the present embodiment, a torsion spring is employed as an urging member, such as the urging spring 51. However, other types of urging springs, such as a helical spring, a leaf spring, or a molded spring, may be employed. The urging spring 51 is not necessarily required. The sheet lift preventing member 50 may be stopped at the position shown in FIG. 14 by its own weight. However, the sheet lift preventing member 50 can be reliably pressed against the peripheral surface 2*b* of the shaft 2*a* if the urging spring 51 is provided.

FIG. 16B shows a state in which the sheet lift preventing member 50 is pressed and rotated by a sheet (not shown), in a direction indicated by an arrow K (downstream side in the sheet conveying direction).

Figure 17:
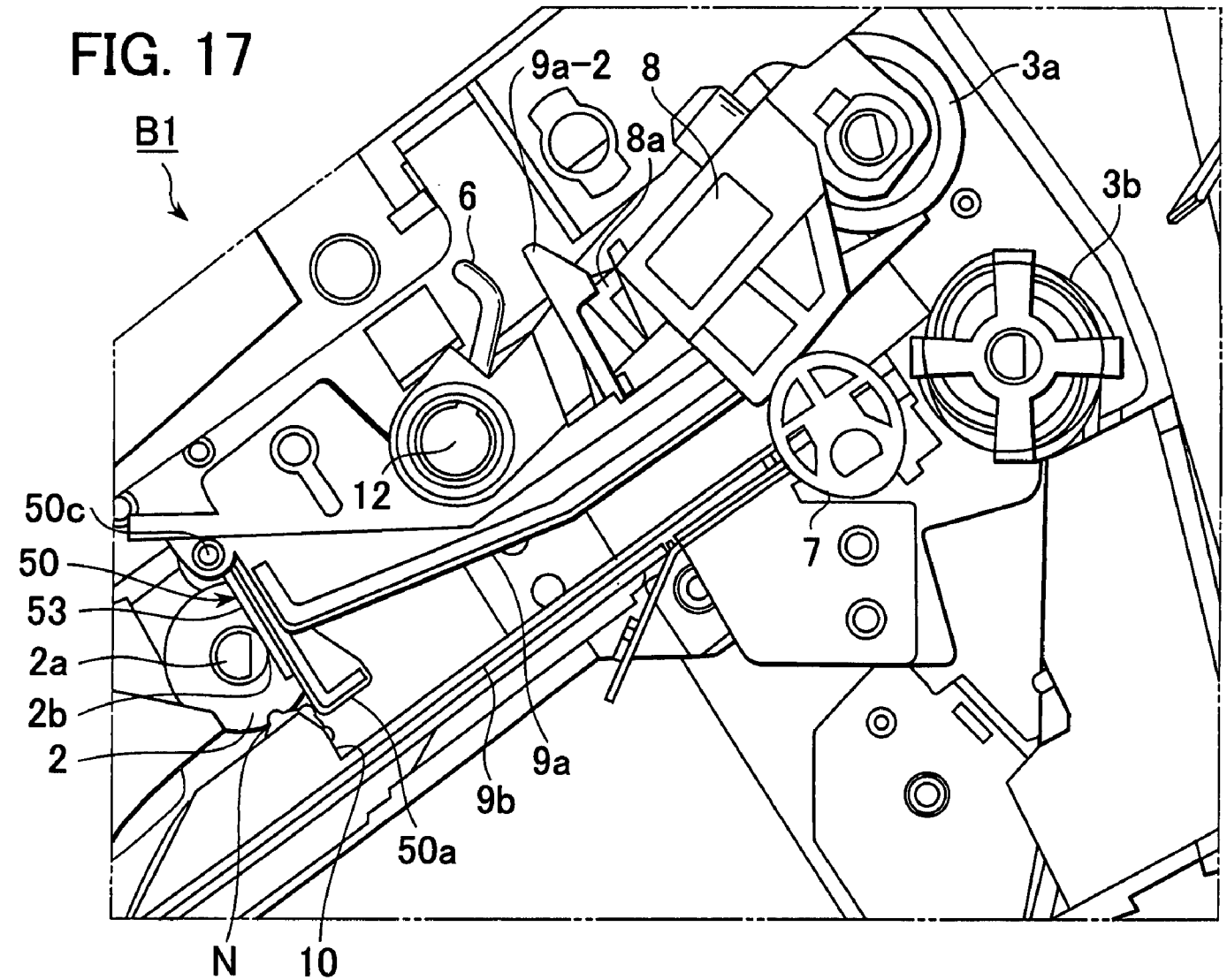
FIG. 17 is an enlarged front view of a principal portion of the sheet processing device shown in FIG. 2 in the sheet processing mode, which corresponds to the second processing mode.
Figure 18:
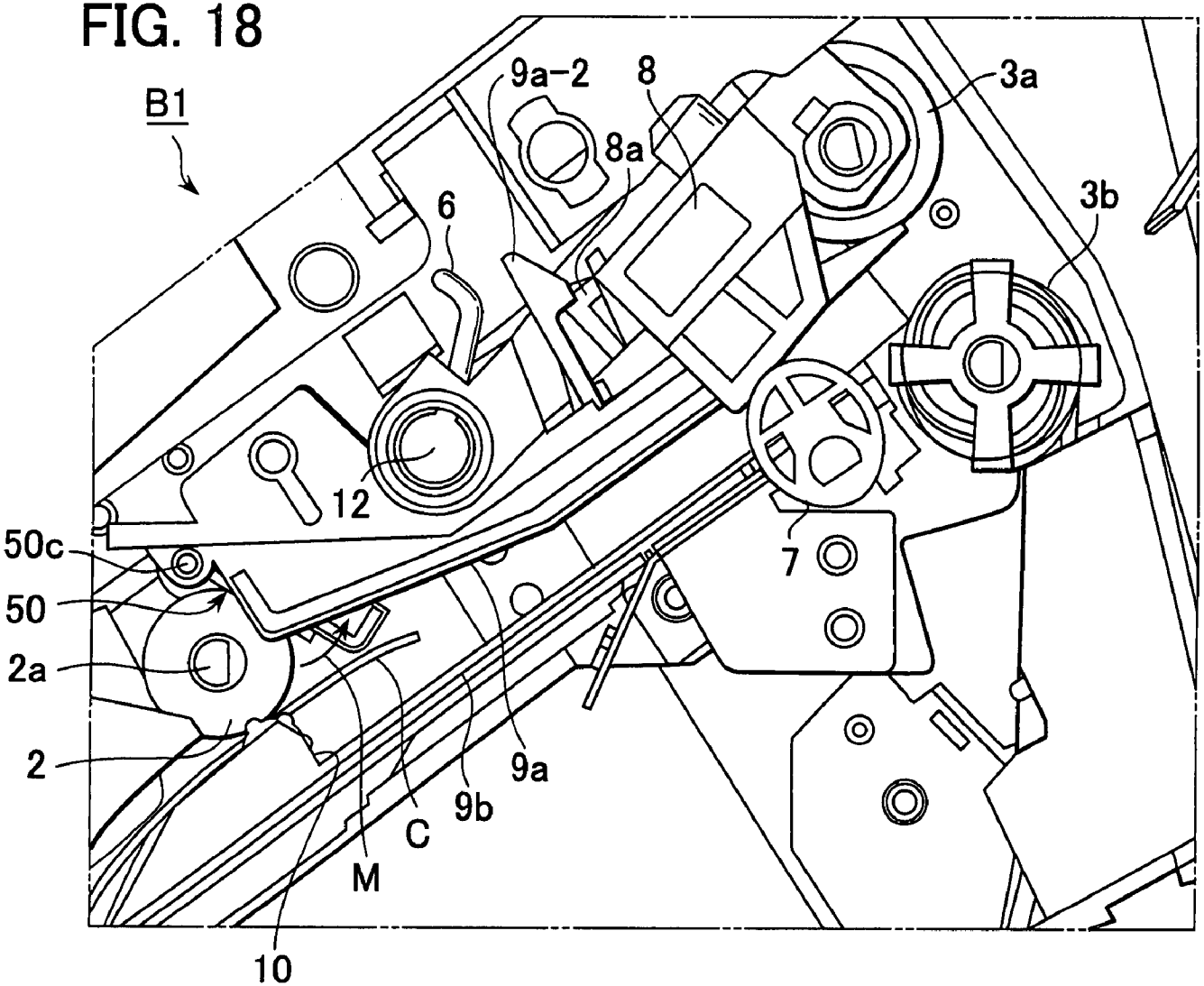
FIG. 18 is a drawing showing a state in which the sheet lift preventing member is held by the conveyed sheet, and is rotated from the state shown in FIG. 17 in the direction indicated by an arrow M.

FIG. 17 is an enlarged front view of a principal portion of the sheet processing device B1 in the sheet processing mode, which corresponds to the second processing mode.

In the sheet processing mode, the upper conveying guide 9*a* and the arm 8 having the upper sheet-discharging roller 3*a* rotate upward about the fulcrum shaft 12, which corresponds to a common center of rotation. At this moment, the sheet lift preventing member 50 is rotatably supported on the upper conveying guide 9*a* by the fulcrum shaft 50*c*, which corresponds to the upstream side of the fulcrum shaft 12 in the sheet conveying direction, and thus moves downward. The lower end 50*a* of the sheet lift preventing member 50, as shown in the drawing, moves to a position lower than the nip line of the intermediate roller 2.

From then on, when the sheet is fed, the sheet lift preventing member 50 is held by the fed sheet, and rotates in a direction indicated by an arrow M against the urging spring 51.

Figure 19:
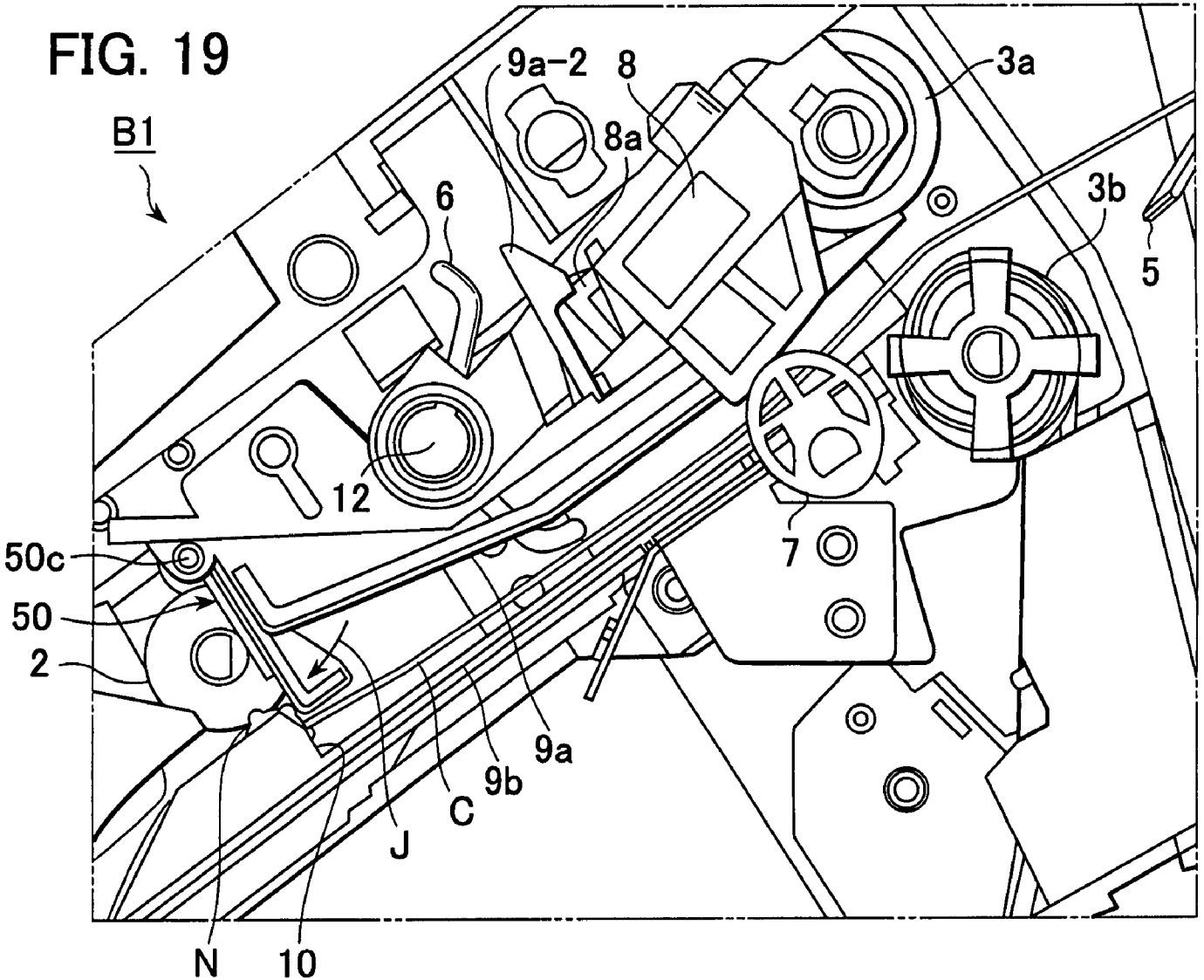
FIG. 19 is a drawing showing a state in which the sheet has completely passed through a nip of intermediate rollers from the state shown in FIG. 18 and the sheet lift preventing member is returned to its original lowered position.

As shown in FIG. 19, when the trailing end of the sheet C has passed completely through a nip N of the intermediate roller 2, the sheet C is stacked on the intermediate stacking station D. As described in conjunction with FIG. 2 to FIG. 14, the sheets C stacked on the intermediate stacking station D are laterally aligned by the joggers 5, and vertically aligned by the paddle 6 and the reference wall 10. At this moment, the sheet lift preventing member 50 is urged in a direction indicated by the arrow J by the urging spring 51, as shown in FIG. 16A, and prevents the trailing end of the sheet C from lifting up by urging the sheet C toward the lower conveying guide 9*b* with the lower end 50*a* thereof. Therefore, as shown in FIG. 19, the trailing end of the sheet C is located at a position lower than the nip N of the intermediate roller 2, and thus does not obstruct feeding of the subsequent sheet.

Figure 20:
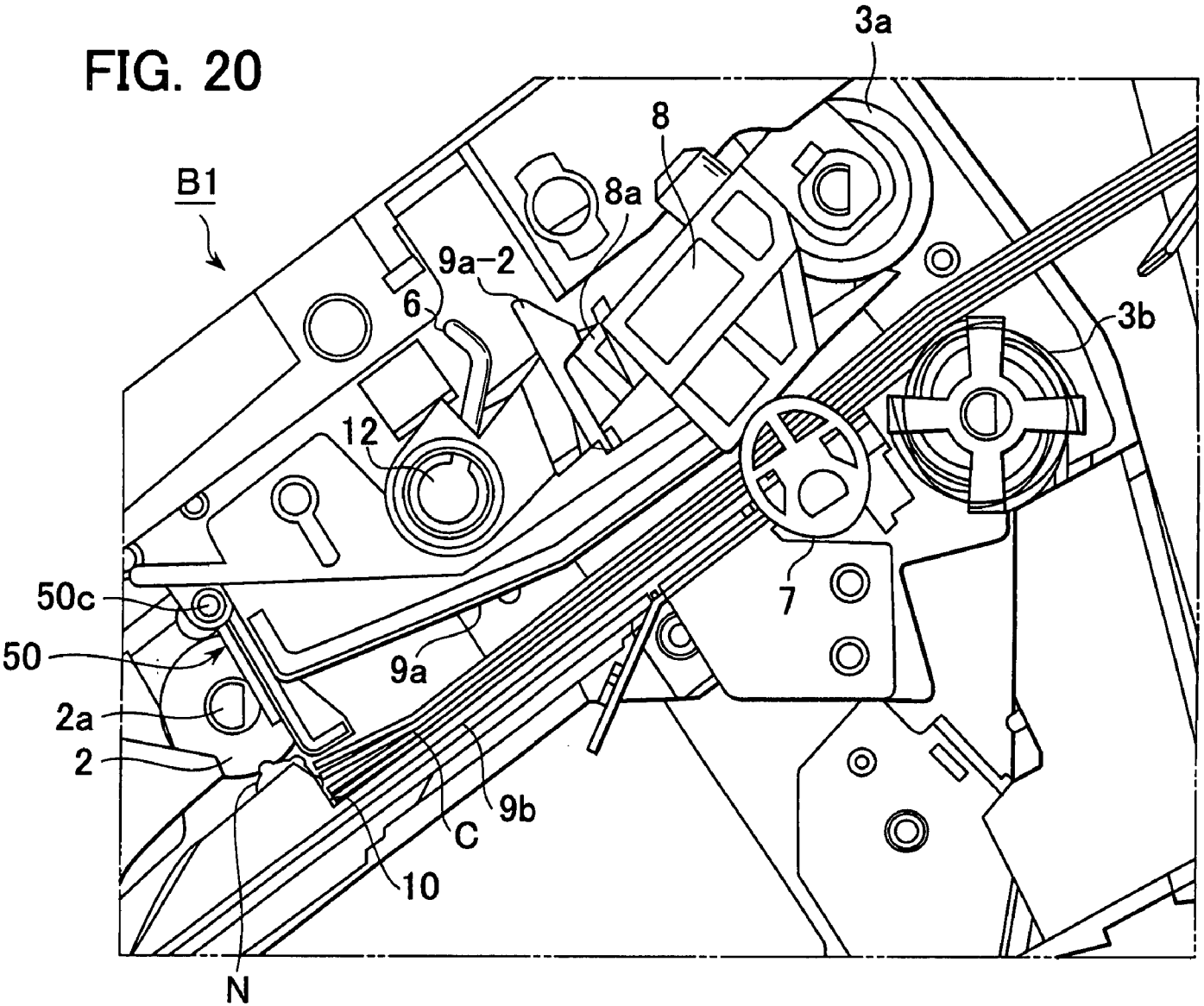
FIG. 20 is a drawing showing a state in which several sheets are fed to the lower conveying guide from the state shown in FIG. 19, and the sheets are held by the sheet lift preventing member.

FIG. 20 is a drawing showing a state in which several sheets are fed into the intermediate stacking station D. At this moment as well, the sheet lift preventing member 50 holds the upper surface of the sheet and prevents the same from lifting up with respect to the nip line of the intermediate roller 2.

Figure 21:
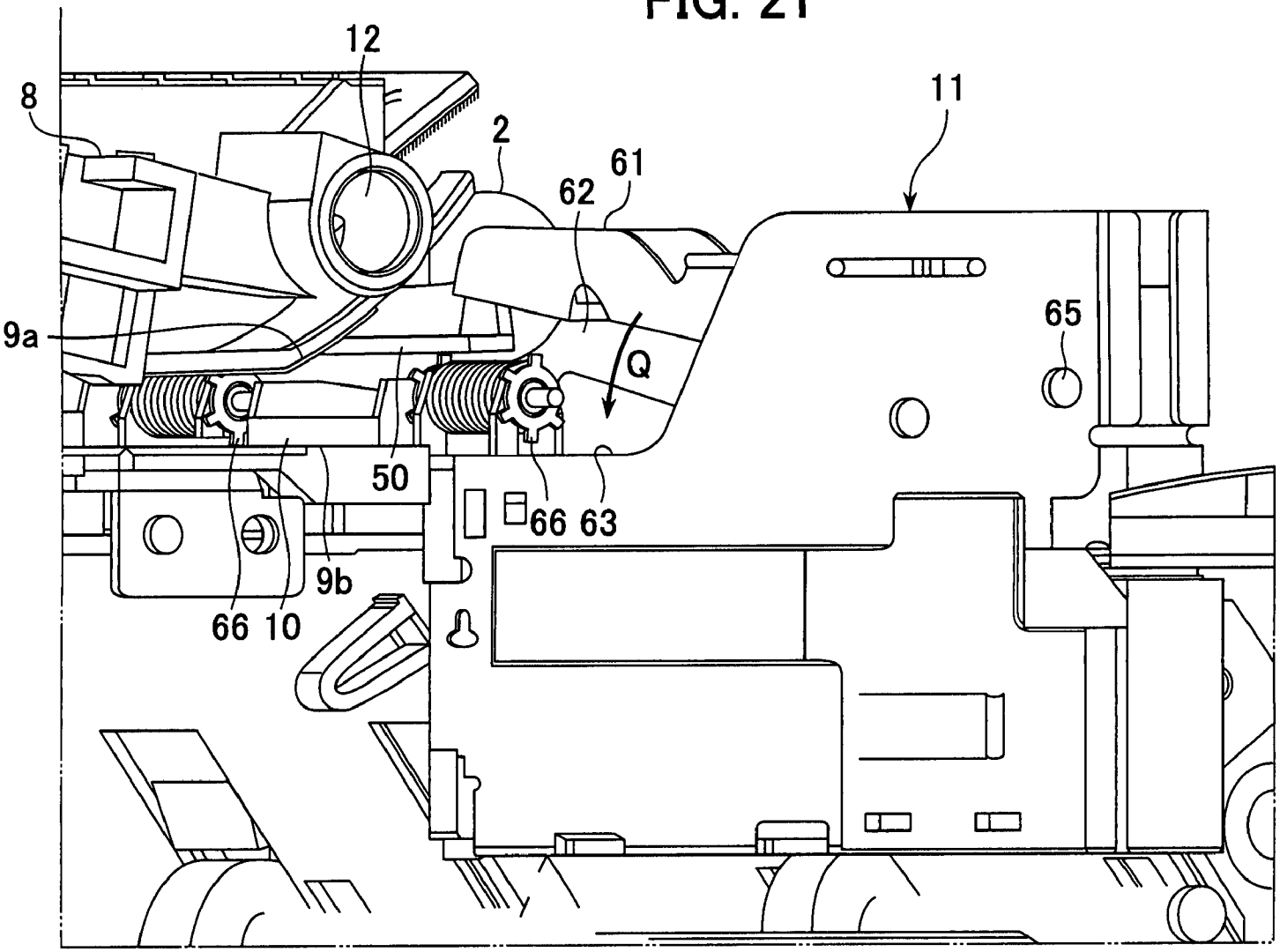
FIG. 21 is a perspective view of a portion around a gap of a stapler and the sheet lift preventing member of the sheet processing device shown in FIG. 2.

FIG. 21 is a perspective view of the portion around a gap 62 of the stapler 11 and the sheet lift preventing member 50. The stapler 11 includes an upper portion 61 on the movable side and a lower portion 63 on the fixed side, so that the upper portion 61 rotates in a direction indicated by an arrow Q about a center of rotation 65, and clamps and staples the sheets in the gap 62.

The lower portion 63 is at substantially the same level as the lower conveying guide 9*b*, which constitutes the intermediate stacking station D. The upper portion 61 is located at a position higher than the nip N between the intermediate roller 2 and the intermediate roller 66.

In other words, the stapler 11 includes the gap 62, and the gap 62 is opened at the home position, so that the sheets are received in the gap, and the upper portion 61 is actuated at the stapling position, and staples the sheets while clamping the sheets from above and below. The lower portion 63, which is the fixed side of the gap, is disposed at substantially the same level as the lower conveying guide 9*b*. The movable side of the gap 62 of the stapler 11 is located at a position above the nip N between the intermediate roller 2 and the intermediate roller 66 at the home position, and the nip N of the intermediate roller 2 and the reference wall 10 are formed within the height of the gap 62.

Figure 22:
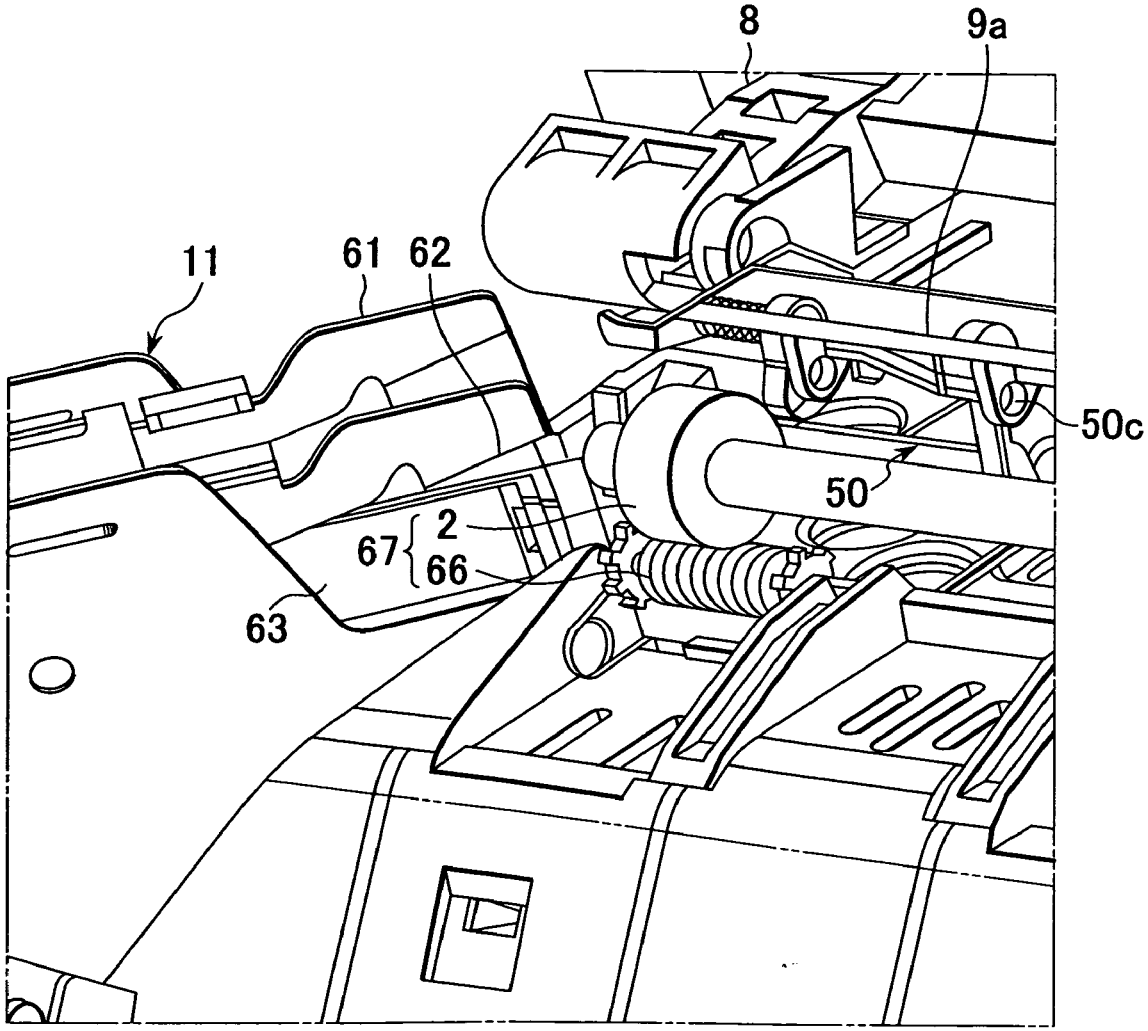
FIG. 22 is a perspective view of the portion around the gap of the stapler and the sheet lift preventing member shown in FIG. 21 as viewed from behind.

FIG. 22 is a perspective view of the portion around the gap of the stapler 11 and the sheet lift preventing member 50 shown in FIG. 21, as viewed from the rear. FIG. 22 shows that the stapler 11 is located in the vicinity of the intermediate roller 2 on the downstream side thereof.

(Sheet Processing Device of Second Embodiment)

FIG. 23 is a front view of a principal portion of a sheet processing device B2 according to the second embodiment. The sheet processing device B2 of the second embodiment is different from the sheet processing device B1 of the first embodiment in the shape of the sheet lift preventing member.

Figure 23A:
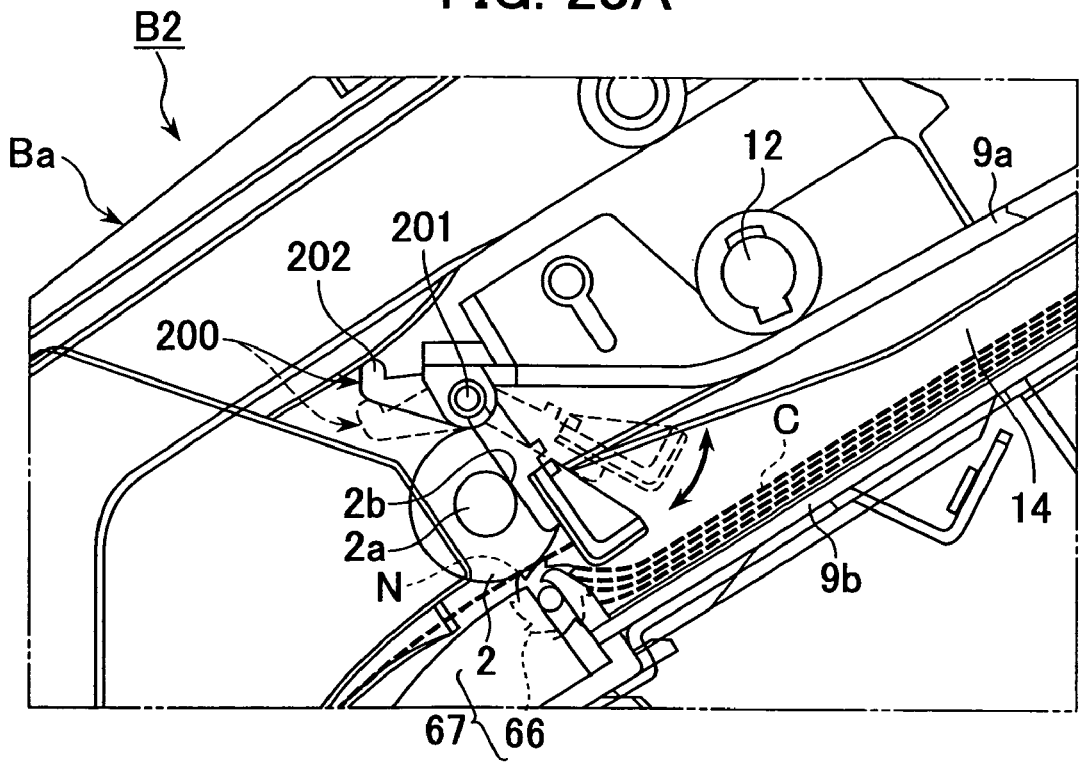
FIG. 23A is an enlarged front view of the principal portion of the sheet processing device in the sheet processing mode, which corresponds to the second processing mode.

FIG. 23A is an enlarged front view of the primary portion of the sheet processing device B2 in the sheet processing mode, which corresponds to the second processing mode.

In the sheet processing mode, as in the case of the sheet processing device B1 of the first embodiment, the upper conveying guide 9*a* rotates counterclockwise in the figure about the fulcrum shaft 12. At this moment, a sheet lift preventing member 200, which is a rotating member, which is rotatably supported by the fulcrum shaft 201 on the upper conveying guide 9*a*, so as to be rotatable in the vertical direction, rotates downward by its own weight, holds the sheets C, which is fed to the intermediate stacking station D, against the lower conveying guide 9*b*, and prevents the same from lifting up, as in the case of the sheet lift preventing member 50 of the first embodiment.

The sheet lift preventing member 200 is received on the peripheral surface 2*b* of the shaft 2*a* of the intermediate roller 2 by its own weight, and positioned in the vicinity of the nip N between the pair of intermediate rollers 67 constituted by the intermediate roller 2 and the intermediate roller 66. The sheet lift preventing member 200 may be rotationally urged by the urging spring and received by the shaft 2*a*.

Figure 23B:
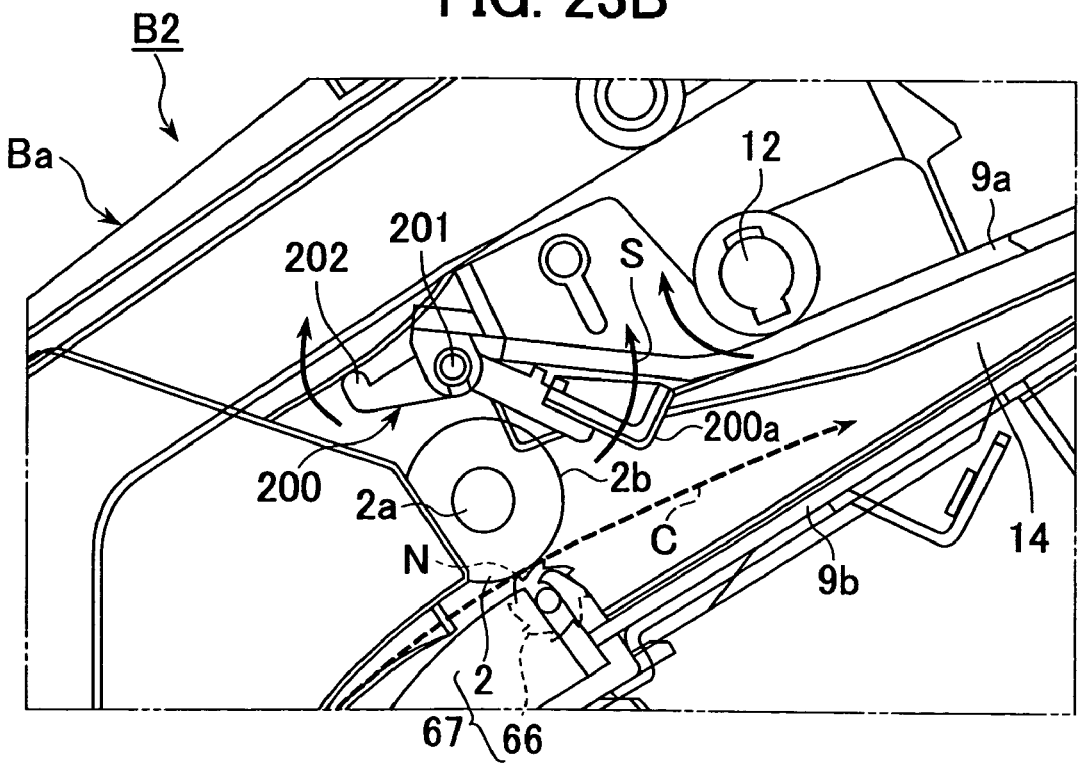
FIG. 23B is an enlarged front view of a principal portion of the sheet processing device in the simple stacking mode, which corresponds to the first processing mode.

FIG. 23B is an enlarged front view of a portion of the sheet processing device B2 in the simple stacking mode, which corresponds to the first processing mode.

In the simple stacking mode, as in the case of the sheet processing device B1 of the first embodiment, clockwise rotation of the upper conveying guide 9*a* moves the sheet lift preventing member 200 upward. However, a lever portion 202, which is an upper end portion, is formed on the upper end of the sheet lift preventing member 200 of the second embodiment. Therefore, when the sheet lift preventing member 200 is moved upward, the lever portion 202 is brought into contact with part of the casing unit Ba, which is a fixed member of the sheet processing device, and thus the sheet lift preventing member 200 is forced to rotate in a direction indicated by an arrow S. Then, a lower end 200*a* of the sheet lift preventing member 200 rotates in the direction away from the sheet. Consequently, the sheet lift preventing member 200 of the second embodiment, being different from the sheet lift preventing member 50 of the first embodiment, not only moves upward, but also is forced to rotate to move away from the sheet.

Therefore, although the sheet processing device B2 of the second embodiment has substantially the same construction as the sheet processing device B1 of the first embodiment, the sheet lift preventing member 200 can reliably be moved away from the sheet to reliably avoid abutment against the sheet.

It is also possible to provide an urging spring such as the urging spring 51 for the sheet lift preventing member 50 in the first embodiment on the sheet lift preventing member 200 to reliably hold the sheet.

(Seat Processing Device of Third Embodiment)

Figure 24A:
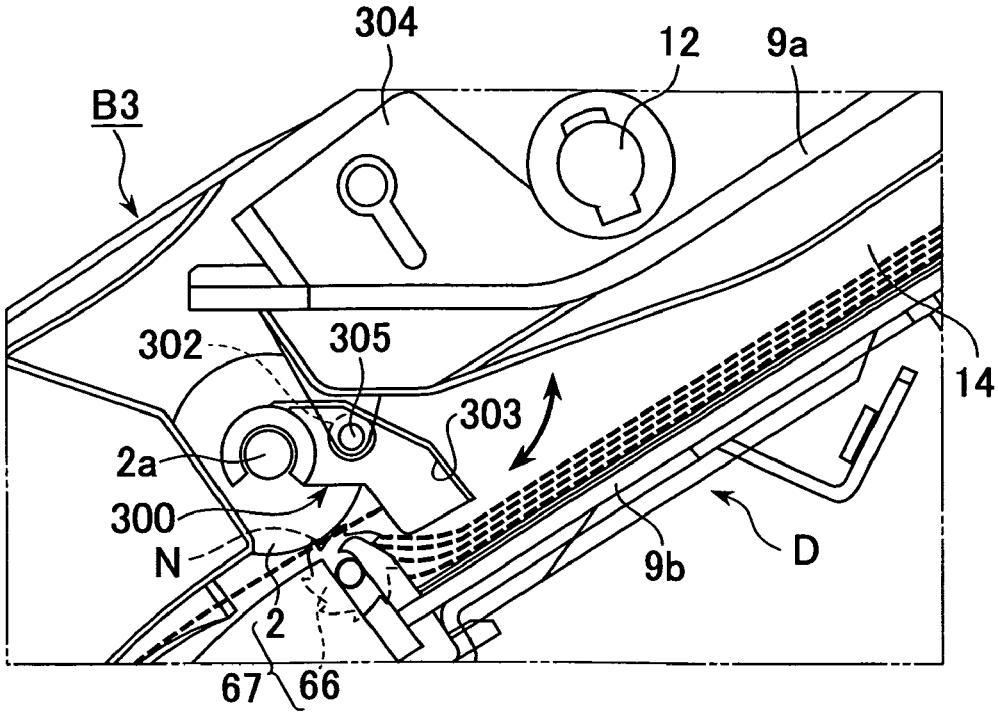
FIG. 24A is an enlarged front view of the principal portion of the sheet processing device in the sheet processing mode, which corresponds to the second processing mode.
Figure 24B:
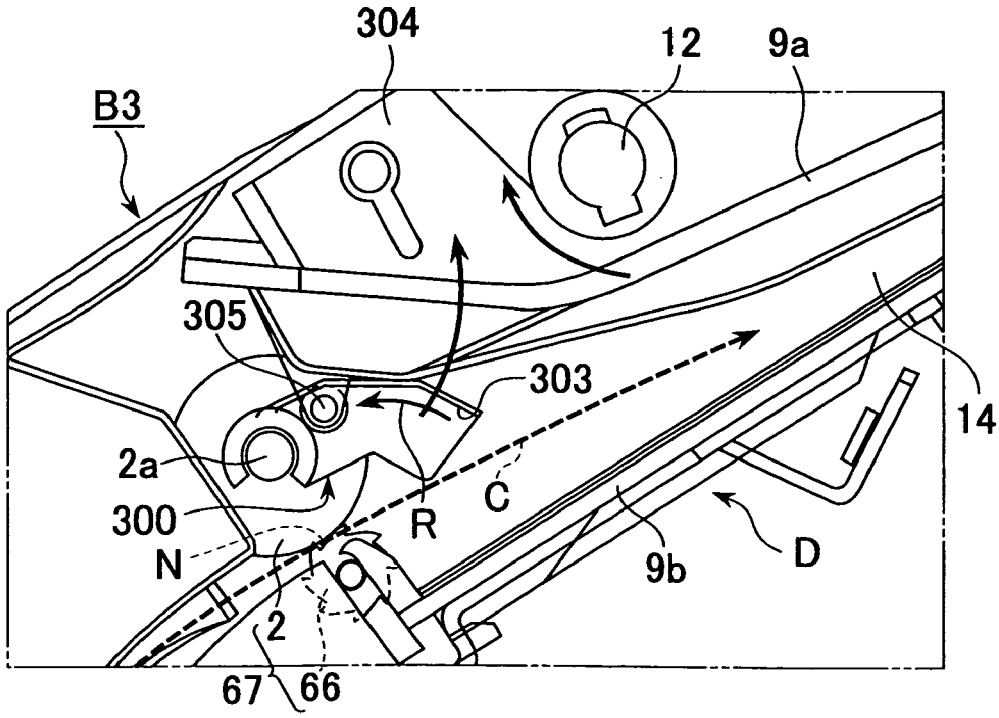
FIG. 24B is an enlarged front view of the principal portion of the sheet processing device in the simple stacking mode, which corresponds to the first processing mode.

FIGS. 24A and 24B are front views of a portion of a sheet processing device B3 according to the third embodiment. The sheet processing device B3 of the third embodiment is third embodiment is also different from the sheet processing device B1 of the first embodiment in the shape of the sheet lift preventing member.

FIG. 24A is an enlarged front view of the portion of the sheet processing device B3 in the sheet processing mode, which corresponds to the second processing mode.

In the sheet processing mode, the sheet lift preventing member 300 in the sheet processing device B3 of the third embodiment rotatably engages the fixed shaft 2*a* of the intermediate roller 2. The sheet lift preventing member 300 is a rotating member. The intermediate roller 2 is an upper rotating member of a pair of sheet-conveying rotating members, and the shaft 2*a* is a fixed member, is a supporting shaft of the upper rotating member of the pair of sheet-conveying rotating members, and is positioned at the center of rotation of the rotating member.

The sheet lift preventing member 300 is urged clockwise in the figure (upstream side in the sheet conveying direction) by an urging spring, which is not shown, as in the first embodiment. The urging spring is not necessarily required. The sheet lift preventing member 300 may be urged clockwise by its own weight. However, the sheet lift preventing member 300 can reliably be urged clockwise if the urging spring is provided.

The sheet lift preventing member 300 shown in FIG. 24A holds the sheet against the lower conveying guide 9*b* as in the case of the sheet lift preventing member 50 of the first embodiment to prevent the sheet C, which is fed to the intermediate stacking station D, from lifting up.

FIG. 24B is an enlarged front view of the portion of the sheet processing device B3 in the simple stacking mode, which corresponds to the first processing mode.

In the simple stacking mode, as in the case of the sheet processing device B1 of the first embodiment, clockwise revolution of the upper conveying guide 9*a* moves a rolling member 305 provided at the upstream end (rear end) of the upper conveying guide 9*a* in the sheet conveying direction slightly upward in a direction indicated by an arrow R. At this moment, the rolling member 305 lifts a cam surface 303 formed on the sheet lift preventing member 300 upward. Consequently, the sheet lift preventing member 300 rotates counterclockwise in the figure and is forced to be lifted. Though the rolling member 305 is rotatably provided on the upper conveying guide 9*a* so as to be capable of sliding easily on the cam surface 303, it may be a pin or projection, which is not rotatable.

Accordingly, in comparison with the sheet lift preventing member 50 of the first embodiment, the sheet lift preventing member 300 not only moves upward, but is also rotated cooperatively and is moved away from the sheet.

Therefore, the sheet processing device B3 of the third embodiment can be moved reliably away from the sheet to avoid abutment against the sheet, though it has substantially the same construction as the sheet processing device B1 of the first embodiment.

In comparison with the sheet processing device B2 of the second embodiment, according to the sheet processing device B3 of the third embodiment, the fulcrum shaft of the sheet lift preventing member 300 is the shaft 2*a* of the fixed intermediate roller 2, and thus the relative positional relationship between the sheet lift preventing member 300 and the nip of the intermediate roller can be accurately set to reliably prevent the sheet from lifting up.

(Other Embodiments)

The arm 8, the upper conveying guide 9*a*, and the sheet lift preventing member 300 of the sheet processing devices B1, B2 and B3 according to the first to third embodiments rotate in the vertical direction. However, it is possible to adapt them to move in parallel with the vertical direction.

The sheet processing means is not limited to the stapler. For example, it must simply be a sheet processing means having a gap and which processes the sheet by opening and closing the gap. For example, it may be a punching device for punching the sheet, a gluing device for gluing the sheets with respect to each other, or a sewing device for sewing a bundle of the sheets with a string.

The upper sheet-discharging rotating member and the lower sheet-discharging rotating member are not limited to a roller. It may be an endless circulating belt.

As described thus far, in the sheet processing devices B1, B2, and B3 according to the present embodiment, the width of the distal end of the sheet path must be reduced in order to ensure feeding of a single sheet, which has passed through the intermediate roller 2 to the nip of the pair of sheet-discharging rollers 3 in the simple stacking mode, and the pair of sheet-discharging rollers 3 move away from each other for stacking the plurality of sheets intermediately once in the sheet processing mode. In addition, since it is necessary to move laterally and align a bundle of sheets on the intermediate stacking station in the sheet processing mode, it is necessary to increase the width of a sheet path 14 in the vertical direction by interlocking (by linking) with the operation to move the upper conveying guide 9*a* away from the pair of sheet-discharging rollers 3.

In the second mode, lateral alignment by the joggers 5 and vertical alignment by the paddle 6 for bringing the sheets into abutment with the reference wall 10, are performed in sequence immediately after the fed sheet has passed through the intermediate roller 2. However, when the trailing end of the preceding sheet, which is aligned already, is lifted up by curling of the sheet, which may occur due to heat fusing by a heat fuser 25 in the main body Aa of the printer A, and thus the sheet is positioned to the higher level than the nip line of the intermediate roller 2, the preceding sheet may abut against the leading end of the subsequent sheet, which is fed by the intermediate roller 2, and thus may be pushed out by the subsequent sheet. On the other hand, the sheet processing device accommodates the intermediate roller 2 and the reference wall 10 in a region of the height of the gap 62 of the stapler 11 provided on the downstream side in the vicinity of the intermediate roller, and accommodates the sheet lift preventing member 50, 200, 300 utilizing the movement of the upper conveying guide 9*a* and a space formed by the upper conveying guide 9*a* in order to reduce the height of the entire apparatus. Therefore, prevention of defective alignment due to lifting or curling of the sheet, as described above, in the intermediate stacking station D may be realized with minimum components, at lower costs, and with reduced space occupation.

As described thus far, the sheet processing devices B1, B2, and B3 in the embodiments are provided with the simple stacking mode, which corresponds to the first processing mode, and the sheet processing mode, which corresponds to the second processing mode. In addition, the upper conveying guide 9*a* is disposed so as to rotate in the vertical direction, the stapler 11 is disposed on the downstream side of the nip of the intermediate roller 2, and the pair of sheet-discharging rollers 3 are disposed on the downstream side thereof. Therefore, the intermediate stacking station D formed by the sheet path 14 from the intermediate roller 2 to the pair of sheet-discharging rollers 3 can be formed into a substantially linear straight path, so that the vertical distance thereof may be reduced. In other words, the vertical space occupied by the sheet path 14 can be reduced in comparison with the related art, so that the height of the apparatus itself may be reduced.

In addition, since the sheet path 14 is formed into a straight path, the simple stacking mode and the sheet processing mode can be performed on the same straight path, and thus the operation of the sheet processing device can be simplified.

The sheet processing devices B1 and B2 of the embodiments include the intermediate stacking station D having the stapler 11 immediately downstream of the intermediate roller 2, and the upper conveying guide 9*a* is adapted to support the sheet lift preventing member 50, 200, so that the sheet lift preventing member 50, 200 is rotatably supported at the fulcrum of rotation 50*c*, 201 positioned upstream of the fulcrum shaft 12 of the upper conveying guide 9*a*. Therefore, the sheet can be prevented from lifting with the simplest construction. In addition, the sheet can be prevented reliably from lifting while the vertical space of the sheet path 14 is reduced in comparison with the related art.

In the sheet processing device B3 of the embodiment, the shaft 2*a* of the intermediate roller 2 is adapted to support the sheet lift preventing member 300 so that the shaft 2*a* is positioned upstream of the fulcrum shaft 12 of the upper conveying guide 9*a*. Therefore, the sheet can be prevented from lifting with the simplest construction. In addition, the sheet can be prevented reliably from lifting up while the vertical space of the sheet path 14 is reduced in comparison with the related art.

According to the sheet processing devices B1, B2, and B3 of the present embodiments, the shaft 50*c*, 201, 2*a*, which serves as a fulcrum of the sheet lift preventing member 50, 200, 300 is provided upstream of the fulcrum shaft 12 of the rotatable upper conveying guide 9*a*. Therefore, corresponding to the change of the sheet path of the intermediate stacking station D between the first mode and the second mode, the sheet lift preventing member 50, 200, 300 moves upward, which is the opposite direction from the descending upper sheet-discharging roller 3*a*, in the first mode in which the sheet lift preventing member 50, 200, 300 is not used, and in the sheet processing mode, which corresponds to the second mode using the sheet lift preventing member 50, 200, 300, the sheet lift preventing member 50, 200, 300 moves downward, which is the opposite direction from the direction in which the upper sheet-discharging roller 3*a* is moved away from the lower sheet-discharging roller 3*b*, and holds the sheet.

Therefore, in the simple stacking mode, the sheet rarely abuts against the sheet lift preventing member 30, 200, 300, which bears the following advantages. The noise occurring when the sheet abuts against the sheet lift preventing member is almost eliminated. Abrasion of the sheet lift preventing member 50, 200, 300 is also reduced. The sheet lift preventing member 50, 200, 300 can be used for a long time. The cost effective sheet lift preventing member 50, 200, 300, which is low in abrasion resistance, can be used. Even when a thin flexible sheet is used, the sheet can be prevented from denting or bending.

According to the sheet processing devices B1, B2, and B3 of the embodiments described above, the sheet lift preventing member 50, 200, 300 is urged toward upstream in the sheet conveying direction by the urging spring 51 when moving downward, and thus the sheet can be prevented reliably from lifting by the sheet lift preventing member 50, 200, 300.

According to the sheet processing devices B1 and B2 of the embodiments described above, positioning of the sheet lift preventing member 50, 200 is achieved by the shaft 2*a* of the intermediate roller 2, the positioning of the sheet lift preventing member 50, 200 can be performed accurately with respect to the nip of the intermediate roller 2.

According to the sheet processing devices B1, B2, and B3, the nip N of the pair of intermediate rollers 67 and the reference wall 10 are accommodated in the vertical region of the gap 62 of the stapler 11 when opened, and a predetermined number of sheets are intermediately stacked therein without lifting. Therefore, the height of the entire apparatus can be reduced. Since the paddle 6, the arm 8 having the upper sheet-discharging roller 3*a*, and the upper conveying guide 9*a* are commonly supported rotatably by the fulcrum shaft 12, a compact apparatus at a lower cost can be provided.

According to the sheet processing devices B1 and B2 of the first and second embodiments, the intermediate stacking station D is formed into a straight path, and the nip of the pair of intermediate rollers 67 and the reference wall 10 are accommodated in the vertical region of the gap 62 of the stapler 11 when opened. Therefore, the straight path can be formed with the simplest construction by providing the sheet lift preventing member 50, 200 rotatably on the upper conveying guide 9*a* for preventing the sheet from lifting, whereby the size, in particular, the height of the entire apparatus can be reduced.

According to the sheet processing device B3 of the third embodiment, the intermediate stacking station D is formed into a straight path, and the nip N of the pair of intermediate rollers 67 and the reference wall 10 are accommodated in the vertical region of the gap 62 of the stapler 11 when opened. In addition, the sheet lift preventing member 300 is rotatably mounted to the shaft 2*a* of the intermediate roller 2 so as to prevent the sheet from lifting in conjunction with the upper conveying guide 9*a*. Therefore, the straight path can be formed by the simplest construction, whereby the size, and in particular the height, of the entire apparatus can be reduced.

According to the sheet processing devices B1, B2, and B3 of the embodiments, the shaft 50*c*, 201, 2*a* which serves as a fulcrum of the sheet lift preventing member 50, 200, 300 is disposed upstream of the fulcrum shaft 12 of the rotatable upper conveying guide 9*a*. Therefore, in the simple stacking mode, that is, when the upper sheet-discharging roller 3*a* is lowered, the sheet lift preventing members 50, 200, 300 can be moved upward in the opposite direction. In other words, without adding a component, the sheet lift preventing member 50, 200, 300 can be moved away from the sheet path by a normal operation taken when moving the sheet lift preventing member away from the sheet path. Accordingly, noise, damage to or undesired folding of the sheet, which may occur when the sheet abuts against the sheet lift preventing member 50, 200, 300, or abrasion of the sheet lift preventing member, can be prevented with the simplest construction at lower costs.

In addition, the printer provided with the sheet processing device, which is low in height, in the main body can also be reduced in height.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet processing device comprising:

a pair of sheet-conveying rotating members for conveying a sheet;

an upper conveying guide provided on the downstream side of said pair of the sheet-conveying rotating members in sheet conveying direction for guiding an upper surface of the sheet conveyed by said pair of sheet-conveying rotating members, said upper conveying guide being shiftable in the vertical direction;

a lower conveying guide provided below said upper conveying guide and opposed thereto for guiding a lower surface of the sheet conveyed by said pair of sheet-conveying rotating members and receiving and stacking the sheets;

upper guide shifting means for shifting said upper conveying guide; and a sheet lift preventing member being shiftable in the vertical direction in conjunction with the shifting movement of said upper conveying guide;

wherein said sheet lift preventing member is shifted to an upper position in spaced relationship to the sheet when a downstream end of said upper conveying guide is shifted downward, and is shifted to a lower position for preventing the sheet from lifting when the downstream end of said upper conveying guide is shifted upward.

2. A sheet processing device according to claim 1, wherein said upper conveying guide is rotatably disposed, said sheet lift preventing member is a rotatable member disposed for rotatable movement, and a center of rotation of said sheet lift preventing member is set to a position upstream in the sheet conveying direction of a center of rotation of said upper conveying guide.

3. A sheet processing device according to claim 2, wherein said sheet lift preventing member is rotatably mounted on said upper conveying guide.

4. A sheet processing device according to claim 3, wherein said sheet lift preventing member is situated so that when an upper end of said sheet lift preventing member is shifted to the upper position, the upper end abuts against a fixed member, and a lower end of said sheet lift preventing member rotates in a direction away from the sheet when the downstream end of said upper conveying guide is shifted downward.

5. A sheet processing device according to claim 2, wherein said sheet lift preventing member is mounted for rotating movement to a fixed member.

6. A sheet processing device according to claim 5, wherein the fixed member is a supporting shaft of an upper rotating member of said pair of sheet-conveying rotating members.

7. A sheet processing device according to claim 2, wherein when said sheet lift preventing member is in the lower position, a lower end of said sheet lift preventing member is positioned below a nip of said pair of sheet-conveying rotating members.

8. A sheet processing device according to claim 2, wherein when said sheet lift preventing member is in the upper position, a lower end of said sheet lift preventing member is positioned above a nip of said pair of sheet-conveying rotating members.

9. A sheet processing device according to claim 2, further comprising urging means for urging said sheet lift preventing member in a direction to move a lower end of said sheet lift preventing member toward the sheet.

10. A sheet processing device according to claim 9, wherein said sheet lift preventing member is received by a supporting shaft of an upper rotating member of said pair of sheet-conveying rotating members.

11. A sheet processing device according to claim 1, further comprising an arm member, said arm member being shiftable in the vertical direction, and arm elevating means for shifting said arm member in the vertical direction, wherein said upper guide shifting means shifts said upper conveying guide in conjunction with the shifting movement of said arm member.

12. A sheet processing device according to claim 11, wherein centers of rotation of said upper conveying guide and said arm member are co-axially disposed.

13. A sheet processing device according to claim 11, wherein said arm elevating means comprises a cam for shifting said arm member in the vertical direction by rotating while remaining in contact with said arm member.

14. A sheet processing device according to claim 11, further comprising an upper sheet-discharging rotating member in opposing relation to each other, wherein said upper sheet-discharging rotating member is disposed on said arm member.

15. A sheet processing device according to claim 14, wherein a plurality of upper sheet-discharging rotating members and lower sheet-discharging rotating members are disposed alternately along an axis of rotation.

16. A sheet processing device according to claim 1, further comprising:

sheet receiving means for receiving an upstream end in the sheet conveying direction of the sheet, which is stacked on said lower conveying guide; and sheet processing means, disposed downstream of said pair of sheet-conveying rotating members, for processing the sheet stacked on said lower conveying guide and received by said sheet receiving means.

17. A sheet processing device according to claim 16, wherein said sheet processing means is a stapler having a gap opening in a vertical direction, and a nip formed by said pair of sheet conveying rotating members and said sheet receiving means are disposed in the vertical opening region of the gap.

18. A sheet processing device according to claim 17, wherein a lower portion of the stapler positioned below the opening is disposed at substantially the same level as said lower conveying guide, and an upper portion of the stapler positioned above the opening is disposed for motion toward and away from the lower portion.

19. A sheet processing device according to claim 16, further comprising an upper sheet-discharging rotating member and a lower sheet-discharging rotating member disposed in horizontally opposing relation to each other, for discharging and conveying the stacked sheet, wherein each of said pair of sheet-conveying rotating members, said lower conveying guide, said sheet receiving means, said sheet processing means, said upper sheet-discharging rotating member and said lower sheet-discharging rotating member are substantially linearly aligned.

20. A sheet processing device according to claim 16, further comprising sheet returning means for returning the sheet conveyed and stacked by said pair of sheet-conveying rotating members on said lower conveying guide in a direction opposite to the sheet conveying direction and bringing the sheet into abutment with said sheet receiving means.

21. A sheet processing device according to claim 19, comprising:

a first processing mode comprising the steps of:

positioning said upper conveying guide and said upper sheet-discharging rotating member at a lower position; and passing sheets through said lower conveying guide and discharging the sheets with said upper sheet-discharging rotating member and said lower sheet-discharging rotating member; and a second processing mode comprising the steps of:

shifting said upper conveying guide and said upper sheet-discharging rotating member upward;

stacking a predetermined number of conveyed sheets intermediately on said lower conveying guide at a position after passing through said pair of sheet-conveying rotating members;

performing processing on the predetermined number of sheets with the sheet processing means, and shifting said upper conveying guide and said upper sheet-discharging rotating member downward; and discharging the predetermined number of sheets by said upper sheet-discharging rotating member and said lower sheet-discharging rotating member.

22. An image forming apparatus comprising:

image forming means for forming an image on a sheet; and a sheet processing device comprising:

a pair of sheet-conveying rotating members for conveying a sheet;

an upper conveying guide provided on the downstream side of said pair of the sheet-conveying rotating members in sheet conveying direction for guiding an upper surface of the sheet conveyed by said pair of sheet-conveying rotating members, said upper conveying guide being shiftable in the vertical direction;

a lower conveying guide provided below said upper conveying guide and opposed thereto for guiding a lower surface of the sheet conveyed by said pair of sheet-conveying rotating members and receiving and stacking the sheets;

upper guide shifting means for shifting said upper conveying guide; and a sheet lift preventing member being shiftable in the vertical direction in conjunction with the shifting movement of said upper conveying guide;

wherein said sheet lift preventing member is shifted to an upper position in spaced relationship to the sheet when a downstream end of said upper conveying guide is shifted downward, and is shifted to a lower position for preventing the sheet from lifting when the downstream end of said upper conveying guide is shifted upward.

23. An image forming apparatus according to claim 22, wherein said upper conveying guide is rotatably disposed, said sheet lift preventing member is a rotatable member disposed for rotatable movement, and a center of rotation of said sheet lift preventing member is set to a position upstream in the sheet conveying direction of a center of rotation of said upper conveying guide.

24. An image forming apparatus according to claim 23, wherein said sheet lift preventing member is rotatably mounted on said upper conveying guide.

25. An image forming apparatus according to claim 23, wherein said sheet lift preventing member is mounted for rotating movement to a supporting shaft of an upper rotating member of said pair of sheet-conveying rotating members.

26. An image forming apparatus according to claim 23, wherein when said sheet lift preventing member is in the lower position, a lower end of said sheet lift preventing member is positioned below a nip of said pair of sheet-conveying rotating members.

27. An image forming apparatus according to claim 23, wherein when said sheet lift preventing member is in the upper position, a lower end of said sheet lift preventing member is positioned above a nip of said pair of sheet-conveying rotating members.

28. An image forming apparatus according to claim 22, further comprising:

sheet receiving means for receiving an upstream end in the sheet conveying direction of the sheet, which is stacked on said lower conveying guide; and sheet processing means, disposed down stream of said pair of sheet-conveying rotating members, for processing the sheet stacked on said lower conveying guide and sheet receiving means.

29. An image forming apparatus according to claim 28, wherein said sheet processing means is a stapler having a gap opening in a vertical direction, and a nip formed by said pair of sheet-conveying rotating members and said sheet receiving means are disposed in the vertical opening region of the gap.

30. An image forming apparatus according to claim 29, wherein a lower portion of the stapler positioned below the opening is disposed at substantially the same level as said lower conveying guide, and an upper portion of the stapler positioned above the opening is disposed for motion toward and away from the lower portion.

31. An image forming apparatus according to claim 28, further comprising an upper sheet-discharging rotating member and a lower sheet-discharging rotating member disposed in horizontally opposing relation to each other, for discharging and conveying the stacked sheet, wherein each of said pair of sheet-conveying rotating members, said lower conveying guide, said sheet receiving means, said sheet processing means, said upper sheet-discharging rotating member and said lower sheet-discharging rotating member are substantially linearly aligned.

* * * * *

UNITED STATES PATENT AND TRADEMARK OFFICE

CERTIFICATE OF CORRECTION

PATENT NO. : 6,997,456 B2
APPLICATION NO. : 10/621345
DATED : February 14, 2006
INVENTOR(S) : Masayoshi Fukatsu et al.

It is certified that error appears in the above-identified patent and that said Letters Patent is hereby corrected as shown below:

COLUMN 15:
Line 41, "third embodiment is" should be deleted.

Signed and Sealed this

Twenty-second Day of August, 2006

JON W. DUDAS
*Director of the United States Patent and Trademark Office*